US007422834B2

(12) United States Patent
Akiyama et al.

(10) Patent No.: US 7,422,834 B2
(45) Date of Patent: Sep. 9, 2008

(54) ELECTROSTATIC LATENT IMAGE DEVELOPING MAGENTA TONER, ELECTROSTATIC LATENT IMAGE DEVELOPER, TONER MANUFACTURING METHOD, AND IMAGE FORMING METHOD

(75) Inventors: Hitomi Akiyama, Minamiashigara (JP); Takashi Hara, Minamiashigara (JP); Kazuya Mori, Minamiashigara (JP); Junichi Tomonaga, Minamiashigara (JP); Yuji Isshiki, Minamiashigara (JP); Takahiro Mizuguchi, Minamiashigara (JP); Satoshi Yoshida, Minamiashigara (JP); Eiji Kawakami, Minamiashigara (JP); Michio Take, Minamiashigara (JP); Takao Ishiyama, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 547 days.

(21) Appl. No.: 11/064,124
(22) Filed: Feb. 23, 2005

(65) Prior Publication Data

US 2006/0046178 A1 Mar. 2, 2006

(30) Foreign Application Priority Data

Aug. 27, 2004 (JP) ..... 2004-249040

(51) Int. Cl.
*G03G 9/08* (2006.01)

(52) U.S. Cl. ..... 430/108.23; 430/108.21; 430/112; 430/114

(58) Field of Classification Search ..... 430/108.23, 430/108.21, 112, 114
See application file for complete search history.

(56) References Cited

U.S. PATENT DOCUMENTS

2003/0194628 A1* 10/2003 Yoshida et al. ..... 430/108.23

FOREIGN PATENT DOCUMENTS

JP 42-23910 11/1942

(Continued)

OTHER PUBLICATIONS

Machine translation of JP 05-142867.*

*Primary Examiner*—Mark A Chapman
(74) *Attorney, Agent, or Firm*—Oliff & Berridge, PLC

(57) ABSTRACT

An electrostatic latent image developing magenta toner includes at least quinacridone pigment, naphthol pigment, and a release agent. Colorant of the toner satisfies conditions (a) and (b): (a) an average primary particle size D50 of a quinacridone pigment represented by formula (1) and an average primary particle size D50 of a naphthol pigment represented by formula (2) are such that the average primary particle size D50 of the quinacridone pigment is smaller than the average primary particle size D50 of the naphthol pigment; and (b) the average primary particle size D50 of the quinacridone pigment is greater than 20 nm, and the average primary particle size D50 of the naphthol pigment is smaller than 200 nm. Formula (1):

Here, each of $R_1$, $R_2$, $R_3$, and $R_4$ is selected from the group consisting of H, $CH_3$, and Cl, $R_1$ and $R_2$ are different from each other, and $R_3$ and $R_4$ are different from each other. Formula (2):

16 Claims, 5 Drawing Sheets

FOREIGN PATENT DOCUMENTS

| | | |
|---|---|---|
| JP | A 63-282749 | 11/1988 |
| JP | A 1-154161 | 6/1989 |
| JP | A 1-225967 | 9/1989 |
| JP | A 2-32365 | 2/1990 |
| JP | B2 2-37586 | 8/1990 |
| JP | A 2-235069 | 9/1990 |
| JP | A 4-226477 | 8/1992 |
| JP | A 5-19536 | 1/1993 |
| JP | A 5-142867 | 6/1993 |
| JP | A 6-250439 | 9/1994 |
| JP | A 11-272014 | 10/1999 |
| JP | A 2000-199982 | 7/2000 |
| JP | A 2001-166541 | 6/2001 |
| JP | A 2001-249498 | 9/2001 |
| JP | A 2002-156795 | 5/2002 |
| JP | A 2003-215847 | 7/2003 |

* cited by examiner

ELECTROSTATIC LATENT IMAGE DEVELOPING MAGENTA TONER, ELECTROSTATIC LATENT IMAGE DEVELOPER, TONER MANUFACTURING METHOD, AND IMAGE FORMING METHOD

BACKGROUND OF THE INVENTION

1. Field of the Invention

The present invention relates to an electrostatic latent image developing magenta toner (hereinafter may be simply referred to as "toner"), to an electrostatic latent image developer, to a method for manufacturing an electrostatic latent image developing magenta toner, and to an image forming method, all of which are used in devices that perform a xerographic process, such as a copier, a printer, or a facsimile, and in particular a color copier.

2. Description of the Related Art

Many types of xerographic processes are conventionally known, such as the method disclosed in Japanese Patent Publication No. Sho 42-23910. In a xerographic process, a latent image is electrically formed, by a variety of means, on a photosensitive member composed of a photoconductive material. The latent image is developed by means of a toner. The toner latent image formed on the photosensitive member is transferred onto a receiver sheet composed of a material such as paper, with or without use of an intermediate transfer member, so as to create a toner image on the sheet. The transferred image is fixed by means of heating, pressurization, heating under pressure, solvent evaporation, or other methods. By performing the above-described steps, a fixed image is produced. Before the above steps are repeated, toner which remains on the photosensitive member is cleaned off as necessary by various methods. In recent years, along with technical advancements in the field of xerography, xerographic processes are being employed not only in regular copiers and printers, but also for near-print purposes. In addition to providing high device speed and reliability, xerographic processes are expected to meet increasingly strict demands for high image quality and hue equivalent to those achieved by a printing press. In particular, red and magenta are important colors, in view of their strong influence on improvement of the impression of an image.

Conventionally, toner is fabricated by means of a kneading-and-grinding method. According to the kneading-and-grinding method, a binding resin is melted and kneaded with additives such as a colorant and a release agent, and subsequently grinded. In a toner obtained by grinding, the colorant and the release agent may become exposed on the toner surface, possibly exerting negative influences on the charging property and life of the toner. Further, when a release agent having a lower melting point is employed to achieve a desired low-temperature fixation property, and an increased amount of release agent is added in order to achieve the preferred oil-less fixation, the release agent may melt out of the toner during the melting and kneading step. Moreover, system viscosity may lower, possibly causing maldistribution of additives within the toner. As such, the kneading-and-grinding method may negatively influence not only the charging property and life of a toner, but also the attained image quality, including color and density. For these reasons, instead of the melting-kneading-grinding method, wet fabrication methods have often been used to fabricate toner in recent years. For example, Japanese Patent Laid-Open Publication Nos. Sho 63-282749 and Hei 6-250439 describe an emulsion polymerization aggregation method. According to this method, resin particles are prepared by emulsion polymerization. A colorant-dispersed liquid having a colorant dispersed within an aqueous medium is also prepared. In accordance with needs, a release-agent-dispersed liquid having a release agent dispersed within an aqueous medium is further prepared. These prepared materials are mixed, and aggregate particles are formed in the mixture by heating or other methods. Subsequently, the aggregate particles are fused by heating to obtain the resulting toner.

Because color images have been used widely and often in recent years, image preservability is another point that is considered important. Conventionally, thermoplastic resin is used to fabricate electrostatic latent image developing toner (hereinafter may be simply referred to as "toner"). In order to simultaneously attain both low-energy fixation and powder blocking property, control for optimization of rheology and glass transition point (hereinafter referred to as "Tg") of resins used for toner is carried out, as described in Japanese Patent Publication No. Hei 2-37586, Japanese Patent Laid-Open Publication No. Hei 1-225967, and Japanese Patent Laid-Open Publication No. Hei 2-235069. In electrostatic latent image developing toners which may be used to print near-print documents, resins having lower Tg are generally selected and employed in order to achieve high-speed fixation. However, an image formed from a toner fabricated on the basis of such techniques is disadvantageous in that, when the image is subjected to heating at a temperature around or higher than Tg, the resin component in the image portion may melt, resulting in adhesion of toner onto the backside of a sheet laid on top or onto other printed sheets. This would cause the image to be defective. Moreover, because near-print documents are often produced by double-sided printing, image portions formed on separate sheets are more likely to be placed in contact with one another as compared to the case where printing is performed on one side only, thereby more frequently causing the above-described image defects (image defects caused in this manner are hereinafter collectively referred to as "image offsets"). In general, whereas black-and-white images mainly comprise text, color images often include numerous graphics. Accordingly, in a color image, the proportion of toner coverage area with respect to sheet area tends to be larger, which is another factor that may cause more frequent image offsets. Image offsets would obviously occur at temperatures higher than Tg, but even at temperatures lower than Tg, image offsets may occur when an image is subjected to high pressure over a long period of time. In color printing, toner preservability may depend on the color of the toner. More specifically, a toner of a specific color may have lower preservability as compared with toners of other colors. Typically, color printing basically employs four toners; black toner, and three color toners consisting of cyan, yellow, and magenta. A cyan toner generally has favorable preservability, which may be influenced by the types and addition amounts of pigments in the toner. However, details as to the basis of high preservability of cyan toners have yet to be clarified. Yellow is a color which is not very noticeable even when image offsets occur to some extent. Therefore, improving preservability of magenta toners is important.

In magenta toners, quinacridone pigments are mainly used, as described in, for example, Japanese Patent Laid-Open Publication Nos. Hei 1-154161 and Hei 2-32365. Further, naphthol pigments may be employed, as disclosed in Japanese Patent Laid-Open Publication Nos. Hei 5-19536, Hei 11-272014, 2001-166541, and 2001-249498. Japanese Patent Laid-Open Publication Nos. Hei 4-226477, Hei 5-142867, 2000-199982, 2002-156795, and 2003-215847 describe using quinacridone pigments and naphthol pigments in combination. Although the above-listed documents describe magenta toners which are enhanced as compared with those of the prior art (in particular, use of quinacridone and naphthol pigments in combination provides favorable magenta toners) with respect to image quality, none of the documents make any reference to image preservability.

The present invention is directed to solving the above-described problem; that is, to improve image preservability of magenta toners to a level equivalent to those of other colors while employing quinacridone pigments and naphthol pigments which have favorable coloring property, developing property, transferability, charging property, and fixation property.

SUMMARY OF THE INVENTION

As a result of studies with respect to particle sizes of quinacridone pigments and naphthol pigments, the present inventors discovered that image preservability of magenta toners can be enhanced when specific particle size combinations are used. In addition, the present inventors have found that, by controlling the wax domain within the toner and performing fixation under predetermined fixation conditions, image preservability can be further enhanced.

More specifically, as a result of extensive research in image preservability, the present inventors have discovered that migration of release agent to the image surface during fixation serves as a significant factor in improving image preservability. In other words, image preservability cannot be improved without sufficient migration of release agent to the image surface. When release agent migration occurs, the release agent actually melts out to be positioned not only on the image surface, but also between toner layers and on the interface between the sheet and the toner layer. As such, when the melt-out amount of release agent is excessive, the release agent not only serves to prevent adhesion of image surfaces to one another, but also undesirably reduces adhesion between toner layers and between a toner layer and the sheet, resulting in degradation of image preservability. Therefore, controlling the melt-out amount of release agent during fixation is important. By also taking into consideration the state of colorant dispersion, the type and state of release agent within the toner, and fixation conditions, the inventors discovered that image preservability becomes enhanced under certain conditions, thereby leading to conception of the present invention.

According to one aspect of the present invention, there is provided an electrostatic latent image developing magenta toner including a quinacridone pigment and a naphthol pigment. The toner is fabricated from a release-agent-dispersed liquid. Colorant of the toner satisfies conditions (a) and (b) below:

(a) an average primary particle size D50 of a quinacridone pigment represented by formula (1) and an average primary particle size D50 of a naphthol pigment represented by formula (2) are such that the average primary particle size D50 of the quinacridone pigment is smaller than the average primary particle size D50 of the naphthol pigment; and (b) the average primary particle size D50 of the quinacridone pigment is greater than 20 nm, and the average primary particle size D50 of the naphthol pigment is smaller than 200 nm.

Formula (1) is as shown below:

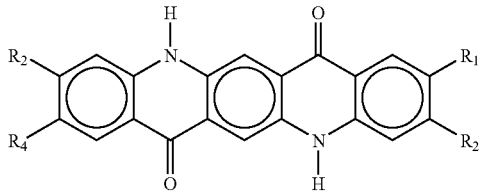

Here, each of $R_1$, $R_2$, $R_3$, and $R_4$ is selected from the group consisting of H, $CH_3$, and Cl, wherein $R_1$ and $R_2$ are different from each other, and $R_3$ and $R_4$ are different from each other.

Formula (2) is as shown below:

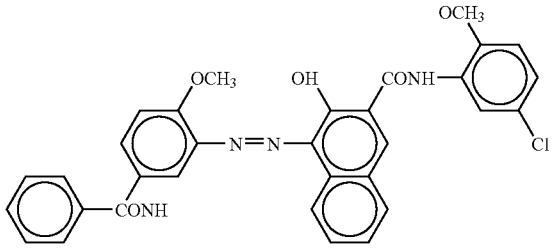

According to another aspect of the present invention, there is provided an electrostatic latent image developer comprising the above-described electrostatic latent image developing magenta toner and a carrier.

According to a further aspect of the present invention, there is provided a method for fabricating an electrostatic latent image developing magenta toner. This method includes mixing a resin-particle-dispersed liquid prepared by dispersing resin particles, a pigment-dispersed liquid prepared by dispersing a quinacridone pigment represented by the above-noted formula (1) and a naphthol pigment represented by the above-noted formula (2), and a release-agent-dispersed liquid prepared by dispersing a release agent. The method further includes forming aggregate particles by aggregating at least the resin particles, the pigments, and the release agent, and subsequently heating the aggregate particles so as to fuse the aggregate particles.

According to a still further aspect of the present invention, there is provided an image forming method comprising the steps of forming a latent image on a latent image carrier, developing the latent image by means of an electrostatic latent image developing toner, transferring the developed toner image onto a receiver, with or without use of an intermediate transfer member, and fixing the toner image on the receiver by heating and pressurizing. A fixation device used for the fixing step comprises rotating members which contact the receiver on front and back sides of the receiver. One of the rotating members is configured in the form of an endless belt. An average nip pressure F during fixation as determined by the equation shown below is no greater than 2.5 kgf/cm$^2$. Further, colorant of the electrostatic latent image developing toner satisfies conditions (a) and (b) below:

(a) an average primary particle size D50 of a quinacridone pigment represented by the above-noted formula (1) and an average primary particle size D50 of a naphthol pigment represented by the above-noted formula (2) are such that the average primary particle size D50 of the quinacridone pigment is smaller than the average primary particle size D50 of the naphthol pigment; and (b) the average primary particle size D50 of the quinacridone pigment is greater than 20 nm, whereas the average primary particle size D50 of the naphthol pigment is smaller than 200 nm.

In the image forming method, F is determined by the equation below:

$$F=A/D/N$$

wherein F (kgf/cm$^2$) denotes average nip pressure during fixation, A (kgf) denotes total load applied on the fixation device, D (cm) denotes average fixation nip width, and N (cm) denotes length of the fixation nip along the axial direction of a roll.

According to the present invention, image preservability of magenta color can be enhanced without negatively influencing other factors such as coloring property, developing property, transferability, fixation property, charging property, powder characteristics, and developer life.

DESCRIPTION OF THE PREFERRED EMBODIMENTS

[Toner and Toner Fabrication Method]

Figure 1:
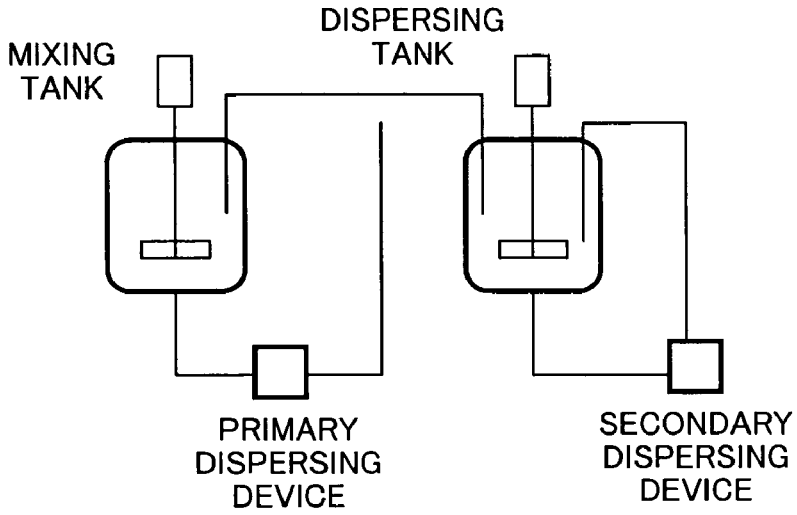
FIG. 1 is a schematic diagram showing a device for fabricating a pigment-dispersed liquid according to an embodiment of the present invention.
Figure 2:
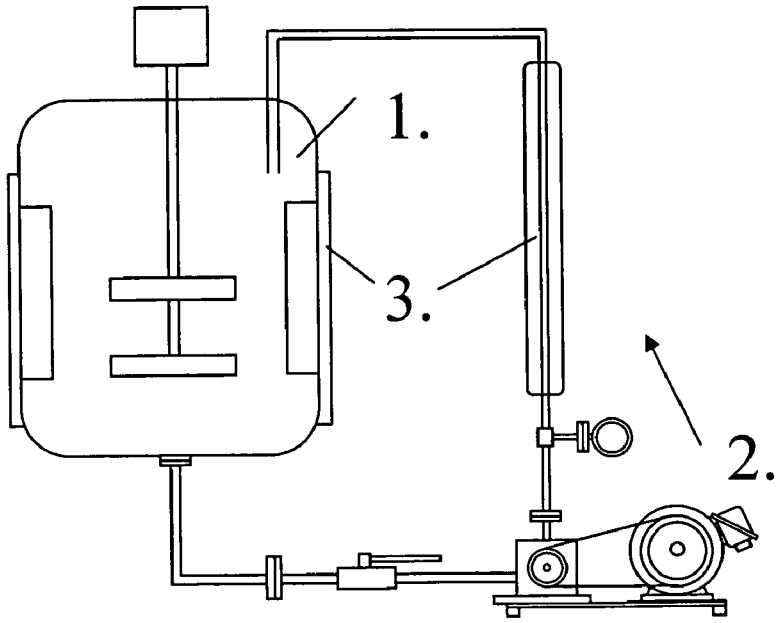
FIG. 2 is a schematic diagram for explaining the general configuration of a disperser used for preparing a liquid mixture of resin particles and a pigment.
Figure 3:
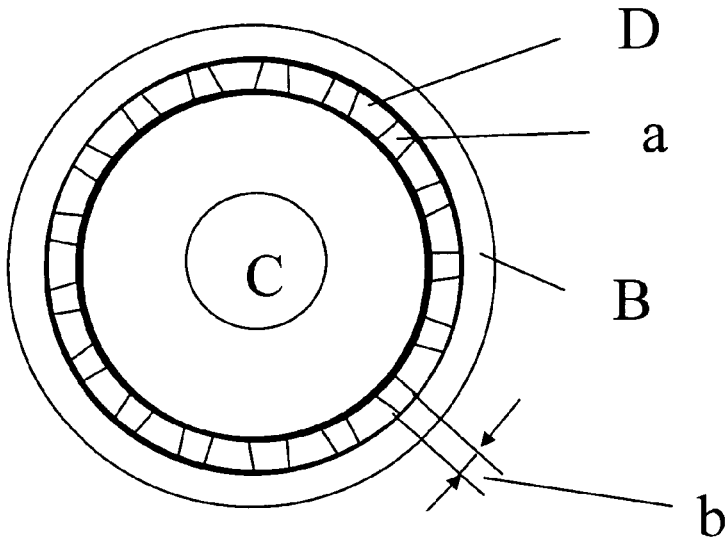
FIG. 3 shows the structure of a stator of the disperser shown in FIG. 2.
Figure 4:
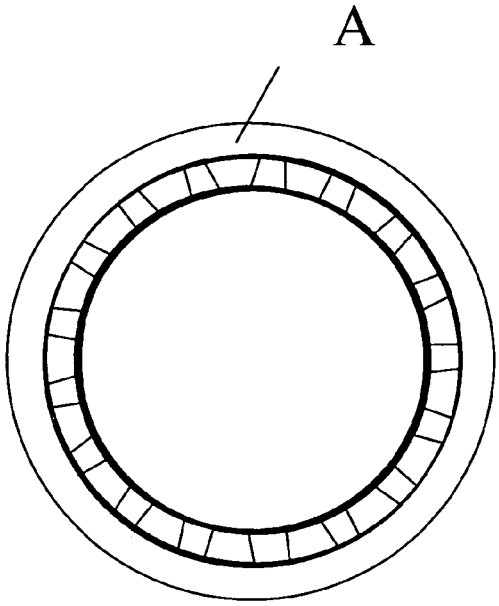
FIG. 4 shows the structure of a rotor of the disperser shown in FIG. 2.
Figure 5:
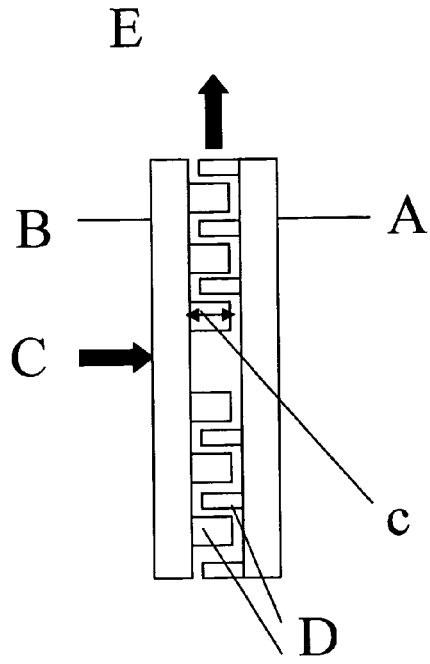
FIG. 5 is a cross-sectional view showing the rotor and stator of the disperser shown in FIG. 2.

A quinacridone pigment used in a magenta toner according to a preferred embodiment of the present invention comprises a pigment having the structure represented by the above-noted formula (1). Specific examples include pigment red nos. 122, 202, and 209. Among these pigments, pigment red 122 is more preferred, in consideration of fabrication and charging property.

As a naphthol pigment, pigment red nos. 31, 146, 147, 150, 176, 238, and 269 can be favorably used. Among these pigments, pigment red nos. 238 and 269, which have the structure represented by the above-noted formula (2), are more preferred, in consideration of fabrication and charging property.

According to the present invention, (a) the average primary particle size D50 of the quinacridone pigment is smaller than the average primary particle size D50 of the naphthol pigment; and (b) the average primary particle size D50 of the quinacridone pigment is greater than 20 nm, whereas the average primary particle size D50 of the naphthol pigment is smaller than 200 nm. Both conditions (a) and (b) must be satisfied simultaneously.

Enhancements in image preservability cannot be attained without satisfying both of the above conditions (a) and (b). Although details as to how image preservability is enhanced have not yet been clarified, the fixation method is related to the image preservability enhancements of the present invention, as will be described later. Accordingly, the conditions (a) and (b) are thought to have effects on migration of the release agent to the image surface during fixation. In a toner fabricated by the kneading-and-grinding method, in some cases the release agent migration property degrades when pigment dispersion is enhanced. This observation suggests that a quinacridone pigment and a naphthol pigment differ from one another in their interaction with the release agent.

Primary particle sizes of the quinacridone and naphthol pigments are measured as outlined below. By use of a transmission electron microscope (TEM), a pigment is observed and photographed under a magnification of ×100,000. Within the photograph, particle images in which the pigment primary particle size can be determined are selected. A tracing paper is fixedly attached to the photograph, and contours of the respective selected pigment particles are marked with a pen. Subsequently, the tracing paper is removed, the marked portions of the paper are cut out separately, and the weight of the cutouts is measured. Separately from the above, a circle having a diameter equivalent to 10 nm in the observed image is created, and the circle is weighed. For every 10 nm over a length equivalent to 200 nm, the weight of the created circle and the weight of the marked cutouts are compared in order to calculate the average particle size. In this manner, the average particle size is calculated by incorporating each projected image as a size equivalent to a circle. In general, the above-described measurement of primary particle size is carried out by performing random sampling with respect to 500 pigment particles.

The quinacridone and naphthol pigments having the above-specified primary particle sizes can be prepared by known methods. For example, there may be employed a solvent salt milling method, a dry milling method, or an acid pasting method described on page 3 of Japanese Patent Laid-Open Publication No. 2003-89756. Further, an azo-coupling method disclosed in Japanese Patent No. 3055673 may alternatively be employed.

The quinacridone pigments and naphthol pigments are preferably mixed at a ratio ranging from 80:20 to 20:80 by weight. When the mixing ratio falls within this range, image preservability enhancements can be attained more effectively. More preferably, the mixing ratio falls within a range of 70:30 to 30:70.

The amount of pigments added to the toner is selected in consideration of hue angle, chrominance, brightness, weatherability, OHP transparency, and dispersibility within the toner. The combined amount of quinacridone and naphthol pigments within the toner preferably falls within a range of 5 to 15 wt %.

In the magenta toner according to the preferred embodiment, colorants other than quinacridone and naphthol pigments may be used for hue adjustment, in an amount no greater than 20 wt % with respect to the total amount of colorant. Examples of other colorants include various known azo and xanthene pigments such as Watchung red, permanent red, brilliant carmine 3B, brilliant carmine 6B, dupont oil red, pyrazolone red, lithol red, rhodamine B lake, lake red C, rose bengal, eosine red, and alizarin lake.

The colorants are preferably prepared in the form of a dispersed liquid prior to toner fabrication.

No particular limitations are imposed on preparation of the colorant dispersed liquid. For example, dispersing devices that can be employed include a rotary-shear-type homogenizer (such as ULTRA-TURRAX (manufactured by IKA) or MILDER-V (manufactured by Pacific Machinery and Engineering Co., Ltd.)); media-type dispersers such as a ball mill, a sand mill, or a DYNO-MILL; ultrasonic dispersers; and high-pressure-impact-type dispersers. An appropriate disperser can be selected in accordance with the types of colorants employed. According to the present invention, an ultrasonic disperser or a high-pressure-impact-type disperser is preferably used to disperse the colorants. When the aqueous system is of low viscosity, a media-type disperser fails to provide sufficient shear force, resulting in failure to attain a desired particle size. A media-type disperser may also disadvantageously crush the colorant particles. In order to achieve a narrow particle size distribution within the dispersed liquid, the process for manufacturing a colorant-dispersed liquid may be performed in two steps. Specifically, in the first step, a disperser which exhibits high performance in pulverizing coarse particles; namely, a media-type disperser (such as DYNO-MILL) or a rotary-shear-type homogenizer (such as ULTRA-TURRAX (product of IKA) or MILDER-V (product of Pacific Machinery and Engineering Co., Ltd.)), is employed to pulverize coarse particles of colorants while the media size and the combination of generators (blades) in the disperser are adjusted in accordance with the cohesive power of the colorant. After deaeration, in the second step, a high-pressure-impact-type disperser such as ULTIMIZER (product of Sugino Machine Ltd.) is used to disperse the colorants, particularly such that the above-noted other colorants attain a dispersed particle size D50 ranging from 50 nm to 250 nm.

When the dispersed particle size is too small, the ratio of colorant surface area to volume becomes large, resulting in deficiency of the dispersant. This may degrade the storage stability of the colorant-dispersed liquid, and possibly cause abnormal aggregation when the colorant-dispersed liquid is combined with other ingredients during the course of toner fabrication. On the other hand, when the dispersed particle size is excessively large, toner transparency and coloring property may become deteriorated, as is well known. The dispersed particle size can be measured by means of a Doppler-scattering-type particle size distribution measurement device (MICROTRAC UPA9340, distributed by Nikkiso Co., Ltd.). Preferably, in the colorant-dispersed liquid, colorant aggregate particles having particle sizes ranging from 500 nm to 800 nm are present in an amount of no more than 3% by number. During toner fabrication by an emulsion polymerization aggregation method to be described later, if many coarse particles are present in the colorant-dispersed liquid, the toner particle distribution may become wide, and free particles may be generated in the toner, leading to degradation of performance and reliability of the toner. The number of such coarse particles can be calculated by analyzing, by means of an image processing device, an image of dried dispersed liquid captured via a transmission electron microscope.

According to the preferred embodiment, the average primary particle size D50 within the quinacridone pigment dispersed liquid falls within a range of 20 nm to 200 nm, more preferably within a range of 50 nm to 150 nm, and the average primary particle size D50 within the naphthol-pigment-dispersed liquid preferably falls within the range of 70 nm to 200 nm. Further, the average primary particle size D50 within the quinacridone-pigment-dispersed liquid is smaller than the average primary particle size D50 within the naphthol-pigment-dispersed liquid.

A process for preparing a dispersed liquid can be divided into two stages. The first stage is preferably carried out such that, when the colorant-dispersed liquid obtained as a result of the first stage is allowed to stand for 90 minutes, the amount of resulting precipitate is no greater than 25 wt % of the dispersed liquid. Because a colorant generally has high specific gravity, coarse particles having large particle sizes tend to precipitate more quickly. Accordingly, appearance of only a small amount of precipitate within a predetermined period of time after the first stage indicates that the amount of coarse particles within the dispersed liquid is small. By reducing the amount of coarse particles in the first stage, a uniform dispersed liquid without coarse particles can be obtained within a short period of time during the second stage. If the amount of precipitate in the first stage is large; that is, if many coarse particles are present, a long dispersion time is required in the second stage for dispersing the coarse particles. Furthermore, crushing of the pigments may occur, thereby generating excessively small particulates. If, in such a case, the active surfaces of the pigments become exposed, additional coarse particles may be formed. The amount of precipitation is determined according to the following method. Five hundred (500) g of a colorant dispersed liquid obtained after completion of the first stage and sufficient deaeration is placed in a 500 ml beaker and allowed to stand for 90 minutes such that precipitation occurs. The supernatant is gently discarded without stirring up the precipitate, and the weight of the remaining precipitate is measured. The measured weight of the remaining precipitate is divided by 500 g (the original weight of the colorant dispersed liquid) and then multiplied by 100 to calculate the weight ratio of precipitate. According to this method, because the precipitate is not dried, the measured weight of the precipitate includes the weight of the aqueous medium. However, this should not raise a problem, because the included amount of aqueous medium is proportional to the amount of precipitate of the coarse particles. The above-specified ratio of precipitate (no greater than 25 wt % of the dispersed liquid) according to the preferred embodiment is determined under the assumption that the ratio of the colorant within the colorant dispersed liquid is 20 wt %. If the colorant ratio is higher, the ratio of precipitate would naturally be higher. When the actual colorant ratio differs from 20 wt %, the calculated ratio of precipitate is compensated while 20 wt % is used as the reference. More specifically, when the colorant ratio is 30 wt %, the calculated ratio of precipitate is compensated by multiplying by 20/30. When the colorant ratio is 10 wt %, the calculated ratio of precipitate is compensated by multiplying by 20/10. The calculated ratio of the precipitate which results when the colorant-dispersed liquid obtained after the first stage is allowed to stand for 90 minutes is preferably no greater than 25 wt % of the dispersed liquid, more preferably no greater than 15 wt %. Although a smaller amount of precipitate is more desirable, achieving zero precipitation is virtually impossible. It should further be noted that, because excessive dispersion processing may damage the colorant, the minimum amount of precipitate may be about 1 wt %.

The volume average particle size D50v of the precipitate is preferably no greater than 30 microns, more preferably no greater than 20 microns. If the particle size of the precipitate is excessively large, coarse particles may remain in the finally-obtained colorant-dispersed liquid. The precipitate particle size may be measured as described below. From the bulk of precipitate which is obtained by discarding the supernatant and used for measuring the ratio of precipitate, a small amount is sampled by use of a spatula or the like. Particle size of the sample is subsequently measured by means of Coulter Multisizer II or Coulter counter Model TA-II (distributed by NIKKAKI) in accordance with normal procedures. A measuring concentration of approximately 5% is appropriate. The measuring aperture size is preferably 100 microns. When determining an average particle size and distribution, the particles are first divided into particle size ranges (channels) on the basis of measured particle distributions. (For example, the range of 1.26 to 50.8 microns is divided into 16 channels in units of 0.1 on the log scale. More specifically, channel 1 ranges from 1.26 to less than 1.59, channel 2 from 1.59 to less than 2.00, and channel 3 from 2.00 to less than 2.52. The logarithm values of the lower threshold values of the respective channels are such that (log 1.26)=0.1, (log 1.59)=0.2, (log 2.00)=0.3, . . . up to 1.6.) In each particle size range, volume D16v denotes a particle size where an accumulated volume in the accumulated distribution from the smaller size side reaches 16% (the 16th percentile). Number D16p denotes a particle size where an accumulated number in the accumulated distribution from the smaller size side reaches 16%. Volume D50v and number D50p denote the corresponding values for an accumulation of 50% in each particle size range, and volume D84v and number D84p denote the corresponding values for 84%. A volume average particle size distribution index GSDv is calculated as $(D84v/D16v)^{1/2}$. A number average-particle size distribution index GSDp is given by $(D84p/D16p)^{1/2}$.

An aqueous dispersion medium used in a colorant-dispersed liquid preferably contains small amounts of impurities such as metal ions, and may be distilled water or ion-exchange water. An alcohol may be added to the medium for the purposes of defoaming and adjustment of surface tension. Further, polyvinyl alcohols and cellulose polymers may be added for adjusting viscosity.

The dispersant used for preparing a colorant-dispersed liquid is typically a surfactant. Favorable examples of the surfactants include anionic surfactants such as sulfate ester salts, sulfonate salts, phosphate ester salts, and soaps; cationic surfactants such as amine salts and quaternary ammonium salts; and non-ionic surfactants such as polyethylene glycols, agents having alkylphenol ethyleneoxide additions, and polyalcohols. Among those listed above, ionic surfactants (anionic and cationic surfactants) are preferred. A non-ionic surfactant is preferably used in combination with an anionic or cationic surfactant. The surfactants can be used as singly or in combination of two or more. The dispersant for a colorant-dispersed liquid preferably has the same polarity as dispersants used in other dispersed liquids, such as the release-agent-dispersed liquid.

Specific examples of anionic surfactants include, but are not limited to, fatty acid soaps such as potassium laurate, sodium oleate, and castor oil sodium; sulfate esters such as octyl sulfate, lauryl sulfate, laurylether sulfate, and nonylphenylether sulphate; sodium alkylnaphthalenesulfonates such as lauryl sulfonate, dodecyl sulfonate, dodecylbenzene sulfonate, triisopropylnaphthalene sulfonate, and dibutylnaphthalene sulfonate; sulfonate salts such as naphthalene sulfonate-formalin condensate, monooctyl sulfosuccinate, dioctyl sulfosuccinate, lauramide sulfonate, and oleamide sulfonate; phosphate esters such as lauryl phosphate, isopropyl phosphate, and nonylphenylether phosphate; sodium dialkylsulfosuccinates such as sodium dioctylsulfosuccinate; and sulfosuccinate salts such as disodium lauryl sulfosuccinate and disodium lauryl polyoxyethylenesulfosuccinate. Among those listed above, alkylbenzene sulfonate compounds are preferred, in consideration of charging property and toner fabrication.

Specific examples of cationic surfactants include, but are not limited to, amine salts such as laurylamine hydrochloride, stearylamine hydrochloride, oleylamine acetate, stearylamine acetate, and stearylaminopropylamine acetate; and quaternary ammonium salts such as lauryl-trimethyl ammonium chloride, dilauryl-dimethyl ammonium chloride, distearyl ammonium chloride, distearyl-dimethyl ammonium chloride, lauryl-dihydroxy-ethyl-methyl ammonium chloride, oleyl-bis(polyoxyethylene)-methyl ammonium chloride, lauroyl-aminopropyl-dimethyl-ethyl ammonium ethosulfate, lauroyl-aminopropyl-dimethyl-hydroxy-ethyl ammonium perchlorate, alkylbenzene-trimethyl ammonium chloride, and alkyl-trimethyl ammonium chloride.

Specific examples of non-ionic surfactants include, but are not limited to, alkyl ethers such as polyoxyethylene octyl ether, polyoxyethylene lauryl ether, polyoxyethylene stearyl ether, and polyoxyethylene oleyl ether; alkyl pheyl ethers such as polyoxyethylene octyl phenyl ether and polyoxyethylene nonyl phenyl ether; alkyl esters such as polyoxyethylene laurate, polyoxyethylene stearate, and polyoxyethylene oleate; alkyl amines such as polyoxyethylene lauryl aminoether, polyoxyethylene stearyl aminoether, polyoxyethylene oleyl aminoether, polyoxyethylene soy aminoether, and polyoxyethylene tallow aminoether; alkylamides such as polyoxyethylene lauramide, polyoxyethylene stearamide, and polyoxyethylene oleamide; vegetable oil ethers such as polyoxyethylene castor oil ether and polyoxyethylene rapeseed oil ether; alkanol amides such as diethanolamide laurate, diethanolamide stearate, and diethanolamide oleate; and sorbitan ester ethers such as polyoxyethylene sorbitan monolaurate, polyoxyethylene sorbitan monopalmitate, polyoxyethylene sorbitan monostearate, and polyoxyethylene sorbitan monooleate.

The amount of dispersant to be added preferably falls within the range of 2 wt % to 30 wt % of the colorant, more preferably 5 to 20 wt %, and further preferably 6 to 15 wt %. When the amount of dispersant is insufficient, the particle size may fail to become sufficiently small, and storage stability of the dispersed liquid may degrade. On the other hand, when the amount of dispersant is excessive, a large amount of dispersant remains within the toner, possibly causing deterioration in toner charging property and powder fluidity.

The magenta toner according to the preferred embodiment can be fabricated by means of any wet fabrication methods, without limitation. One wet fabrication method is a suspension polymerization method as disclosed in Japanese Patent Laid-Open Publication Nos. Hei 8-44111 and Hei 8-286416, in which a colorant, release agent, and the like are dispersed and suspended within an aqueous medium together with polymerizing monomers, and subsequently the components are polymerized by means of the polymerizing monomers. Another wet fabrication method is an emulsion polymerization aggregation method as disclosed in Japanese Patent Laid-Open Publication Nos. Sho 63-282749 and Hei 6-250439. According to this method, resin particles are prepared by emulsion polymerization. A colorant-dispersed liquid having a colorant dispersed within an aqueous medium is also prepared. In accordance with necessity, a release-agent-dispersed liquid having a release agent dispersed within an aqueous medium is further prepared. These prepared materials are mixed, and aggregate particles are formed in the mixture by heating or other methods. Subsequently, the aggregate particles are fused by heating, to thereby obtain the resulting toner. Among the wet fabrication methods, the emulsion polymerization aggregation method is preferred, in consideration of the toner particle size distribution and particle shape control.

The emulsion polymerization aggregation method is a fabrication method comprising an aggregation process and a fusion process (this fabrication method may be hereinafter referred to as the "aggregation fusion method"). In the aggregation process, aggregate particles are formed within a dispersed liquid having at least resin particles dispersed therein, so as to produce an aggregate-particle-dispersed liquid. In the fusion process, the aggregate-particle-dispersed liquid is heated to fuse the aggregate particles.

The emulsion polymerization aggregation method may further comprise an adhesion process performed between the aggregation process and the fusion process. In the adhesion process, a -particle-dispersed liquid is added and mixed into the aggregate-particle-dispersed liquid, so as to allow particles to adhere to the aggregate particles, thereby forming coated aggregate particles.

In the adhesion process, in order to attach particles to the aggregate particles to form coated aggregate particles, a -particle-dispersed liquid is added and mixed into the aggregate-particle-dispersed liquid which is prepared in advance in the aggregation process. Because the particles to be adhered are newly added to the prepared aggregate particles, the added particles may be herein referred to as "additional particles." The additional particles may comprise, for example, resin particles combined with particles of a single or multiple types, such as release agent particles and colorant particles. No particular limitations are imposed on the method for adding and mixing the -particle-dispersed liquid. The adding and mixing may be performed in a gradual and continuous manner, or in a stepwise manner by dividing the added liquid into multiple portions. By adding and mixing the additional particles, generation of excessively small particulates can be minimized, enabling attainment of a narrow particle size distribution in the resulting electrostatic latent image developing toner, thereby contributing to production of a high-quality image. Further, by performing the adhesion process, a pseudo shell structure can be formed on the toner particles. The pseudo shell structure serves to reduce exposure of the internal components, such as the colorant and release agent, to the toner surface, leading to enhancement in toner charging property and life. Moreover, the pseudo shell structure functions to maintain uniform particle size distribution and prevent changes in particle sizes during the fusion process. This eliminates the need to add a surfactant or a basic or acidic stabilizer for the purpose of increasing stability of the system during fusion, or at least minimizes the required amount of such additives, thereby achieving cost reductions and possibly quality improvements. For these reasons, when a release agent is employed, adding the additional particles which are mainly composed of resin particles is preferable.

According to the above-described toner fabrication method, toner shape can be controlled by adjusting factors such as temperature, agitation rate, and pH during the fusion process. After completion of the fusion (particle forming) process, the toner particles are cleansed and dried to obtain the final-product toner. In consideration of toner charging property, sufficient displacement washing using ion-exchange water is preferably performed. The degree of cleansing is typically monitored by detecting conductivity of the filtrate. The cleansing process may include a step of neutralizing ions using an acid or base. Although no particular limitations are imposed on the solid-liquid separation step performed after the cleansing process, in view of productivity, this step is preferably performed by vacuum filtration or pressurized filtration. Further, although no particular limitations are imposed on the drying method, methods such as freeze drying, flushing jet drying, fluidized drying, and vibro-fluidized drying are employed, in view of productivity.

The resin particles used in the aggregation process and the additional resin particles are composed of thermoplastic polymers which serve as the binder resin. Examples include, but are not limited to, styrenes such as styrene, para-chloro styrene, and α-methyl styrene; esters having a vinyl group, such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; olefins such as ethylene, propylene, and butadiene; and homopolymers of the above-listed substances, copolymers obtained by combining two or more of the above-listed substances, and condensates thereof. Examples of the resin particles further include non-vinyl condensed resins such as epoxy resin, polyester resin, polyurethane resin, polyamide resin, cellulose resin, and polyether resin; a mixture of these non-vinyl condensed resins and the above-listed vinyl-based resins; and graft polymers obtained by polymerizing vinyl-based monomers under the presence of the non-vinyl condensed resin polymers. A single type of these resins may be employed alone, or two or more of these resins may be used in combination. Among the above-noted resins, vinyl-based resins are particularly preferred. Vinyl-based resins are advantageous in that a resin-particle-dispersed liquid using those resins can be prepared easily by emulsion polymerization or seed polymerization using an ionic surfactant or the like.

No particular limitations are imposed on the method for preparing a dispersed liquid containing the above-noted resin particles. Although the preparation method can be appropriately selected in accordance with needs, a resin-dispersed liquid may be prepared as described below, for example.

When the resin component in the resin particles comprises homopolymers or copolymers of vinyl-based monomers (vinyl-based resin) such as esters having a vinyl group, vinyl nitrites, vinyl ethers, or vinyl ketones listed above, the vinyl-based monomers may be subjected to emulsion polymerization or seed polymerization within an ionic surfactant. As a result, a dispersed liquid containing resin particles composed of homopolymers or copolymers of the vinyl-based monomers (vinyl-based resin) dispersed within the ionic surfactant can be prepared. In a case in which the resin component of the resin particles comprises a resin other than homopolymers or copolymers of the above-listed vinyl-based monomers, and the resin is soluble in an oil-based solvent having relatively low solubility in water, the resin may be dissolved in the oil-based solvent. The obtained solution is added to water along with an agent such as an ionic surfactant noted above or a polymeric electrolyte. A disperser such as a homogenizer is used to disperse the particles within the mixture. Subsequently, the oil-based solvent is evaporated from the mixture by heating and/or depressurizing, thereby producing a dispersed liquid having the resin particles dispersed therein. When the resin particles to be dispersed within a liquid are composite particles including components other than the resin, the particle-dispersed liquid may be prepared as described below. For example, the respective components of the composite particles may be dissolved and dispersed within a solvent. Subsequently, similar to the above case, the obtained solution is dispersed within water by means of an appropriate dispersant, and the mixture is heated and/or depressurized so as to remove the solvent. Alternatively, the particle-dispersed liquid may be prepared by forming a latex by emulsion polymerization or seed polymerization, and subjecting the latex surface to a mechanical shear force or electric adhesive force so as to immobilize the respective components of the composite particles.

The volume median diameter (median diameter) of the resin particles is preferably no greater than 1 μm, more preferably within the range of 50 to 400 nm, and further preferably within the range of 70 to 350 nm. When the volume average particle size of the resin particles is excessively large, the particle distribution within the resulting electrostatic latent image developing toner may become wide, and free particles may be generated in the toner, leading to degradation of performance and reliability of the toner. On the other hand, when the volume average particle size of the resin particles is too small, the liquid viscosity during toner fabrication may become high, resulting in a wide particle distribution in the final-product toner. When the volume average particle size of the resin particles falls within the above-specified ranges, these disadvantages can be avoided. In addition, maldistribution of the resin particles within the toner can be minimized. By achieving favorable distribution within the toner, variances in performance and reliability of the toner can be reduced. The volume average particle size of the resin particles can be measured by means of a Doppler-scattering-type particle size distribution measurement device (MICROTRAC UPA9340, distributed by Nikkiso Co., Ltd.).

In the magenta toner according to the preferred embodiment, a release agent is included for the purpose of enhancing fixation property and image preservability.

A release agent to be used in the toner of the preferred embodiment must be a substance which has a main body maximum endothermic peak at 60-120° C. as measured according to ASTM D3418-8, and melt viscosity of 1-50 mPas at 140° C. A release agent melting point below 60° C. is too low as the wax transition temperature, possibly causing toner blocking and degradation of developing property of the toner when the temperature within the copier or printer becomes high. A melting point above 120° C. is too high as the wax transition temperature. When a release agent having such a high melting point is employed, fixation at a high temperature may be possible, but this is undesirable, in view of energy consumption. Further, when melt viscosity of the release agent exceeds 50 mPas, the release agent will not sufficiently melt out of the toner. As a result, releasability provided by the release agent during fixation becomes inadequate. Viscosity of the release agent according to the preferred embodiment is measured by means of an E-type viscometer (manufactured by Tokyo Keiki Co., Ltd.) including an oil-circulated thermostatic bath. More specifically, the measurement is performed by means of a combination of a cone having a cone angle of 1.34° and a cup defining a plate at its bottom portion. The temperature of the circulation system is set to 140° C. The empty measurement cup and the cone are mounted on the measurement device, and the temperature is maintained at a constant level by circulating the oil. When the temperature is stabilized, 1 g of the sample to be measured is placed inside the measurement cup, and the cone is held in position for 10 minutes. After stabilization, the cone is rotated to execute measurement. The rotational speed of the cone is 60 rpm. The measurement process is repeated three times, and an average of the obtained values is employed as viscosity The release agent preferably has a heat absorption starting point temperature of 40° C. or higher on the DSC curve as measured by a differential scanning calorimeter. More preferably, the heat absorption starting temperature is 50° C. or higher. When this temperature is below 40° C., toner agglomeration may occur within the copier or the toner bottle. It should be noted that the heat absorption starting temperature denotes a temperature level at which the heat absorption rate of the release agent with respect to temperature increase starts to change. The heat absorption starting temperature depends on the type and number of low molecular weight components within the entire molecular weight distribution of the wax, and polar groups in the structures of those components. In general, by polymerizing a wax to attain high molecular weight, the heat absorption starting temperature can be increased along with the melting point. However, when this method is used, the wax loses its natural low melting point and low viscosity. Instead, an effective method is to selectively remove low molecular weight components within the molecular weight distribution of the wax. In order to execute the removal, methods such as molecular distillation, solvent separation, and gas chromatographic separation may be employed. The DSC measurement may be performed by means of "DSC-7" manufactured by PerkinElmer, Inc., for example. At the detector portion of this instrument, temperature compensation is effected using the melting points of indium and zinc, while caloric compensation is effected using the heat of fusion of indium. The sample to be measured is placed in an aluminum pan. An empty pan serving as the control is also mounted in the instrument. Measurement is executed while temperature is increased from room temperature at a rate of 10° C./minute. Specific examples of the release agent include, but are not limited to, low molecular weight polyolefins such as polyethylene, polypropylene, and polybutene; silicones which exhibit a softening point when heated; fatty acid amides such as oleamide, erucamide, ricinoleamide, and stearamide; plant-based wax such as carnauba wax, rice wax, candelilla wax, sumacs wax, and jojoba oil; animal-based wax such as beeswax; mineral-based wax and petroleum-based wax such as montan wax, ozokerite, ceresin, paraffin wax, microcrystalline wax, and Fischer-Tropsh wax; ester waxes such as higher fatty acid ester, montan acid ester, and carboxylate ester; and modified products of the above-listed substances. A single type of release agent may be used alone, or alternatively, two or more types of release agents may be employed in combination.

The amount of the release agent to be added to the magenta toner preferably falls within the range of 5-40 wt %, and more preferably within the range of 5-20 wt %. An insufficient amount of release agent leads to inferior fixation property, whereas an excessive amount of release agent may cause degradation in toner powder characteristic and filming on the photosensitive member.

According to the present invention, it is particularly preferable to use a release agent which is classified as a polyalkylene, has a maximum endothermic peak at 75-95° C. measured by a differential scanning calorimeter ("DSC-7" manufactured by PerkinElmer, Inc.), and has a melt viscosity of 1-10 mPas at 140° C. Furthermore, the polyalkylene content within the magenta toner preferably falls within the range from 6 to 9 wt %. If the melting point of the release agent is excessively low (that is, if the maximum endothermic peak is lower), or if the added amount of the release agent is excessive, physical strength of the toner layer at the interface with the sheet may be lowered. On the other hand, if the melting point of the release agent is excessively high (that is, if the maximum endothermic peak is higher), in consideration of image preservability, melt-out of the release agent to the image surface is insufficient. If viscosity of the release agent is too low, physical strength of the toner layer may be lowered, whereas an excessively high viscosity would result in insufficient melt-out of the release agent to the image surface, in view of image preservability. The above-noted "polyalkylene" denotes a substance such as polyethylene, polypropylene, or polybutene, which is obtained by performing addition polymerization of polymeric monomers expressed by $C_nH_{2n}$ (wherein $2 \leqq n \leqq 4$, and n is a natural number) and has a number average molecular weight not greater than 1200.

The release agent is added to water together with a polymeric electrolyte such as an ionic surfactant, polymeric acid, or polymeric base. The release agent is dispersed into particles by means of a homogenizer or pressure-injection-type disperser (such as "Gaulin homogenizer" manufactured by GAULIN) which is capable of applying a strong shear force, while the mixture is heated to a temperature higher than the melting point of the release agent. A release-agent-dispersed liquid may be prepared in this manner.

The release-agent-dispersed liquid preferably has an average dispersed particle size D50 ranging from 180 to 350 nm, more preferably 200 to 300 nm. Further, the release-agent-dispersed liquid preferably does not include coarse particles of sizes exceeding 600 nm. If the dispersed particle size is excessively small, the release agent may fail to sufficiently melt out during fixation, possibly resulting in a decrease in the hot offset generation temperature. If the dispersed particle size is excessively large, the release agent may become exposed on the toner surface, causing degradation of toner powder characteristic and filming on the photosensitive member. If coarse particles are present in the release-agent-dispersed liquid, because coarse particles are not readily incorporated into the toner by the wet fabrication method, free release agent particles would be generated, possibly contaminating the developing sleeve and the photosensitive member. The dispersed particle size can be measured by means of a Doppler-scattering-type particle size distribution measurement device (MICROTRAC UPA9340, distributed by Nikkiso Co., Ltd.).

The release-agent-dispersed liquid employed for fabricating the magenta toner of the preferred embodiment must be prepared such that the ratio of dispersant to release agent within the dispersed liquid falls within the range of 1 to 20 wt %. If the dispersant ratio is excessively low, the release agent may fail to be sufficiently dispersed, resulting in inferior storage stability. On the other hand, an excessively high dispersant ratio in the release agent dispersed liquid may degrade charging property and, in particular, environmental stability of the resulting toner. Further, the amounts of dispersants may be adjusted such that the ratio (P) of dispersant to colorant within the colorant-dispersed liquid and the ratio (W) of dispersant to release agent within the release-agent-dispersed liquid satisfy the relationship $P>1.3W$. When this relationship is satisfied, incorporation of the colorant and the release agent into the toner is promoted, resulting in improved toner charging property and powder characteristic. This phenomenon is believed to have its basis in the colorant including a greater number of small particles as compared to the release agent, and therefore having a greater total surface area, which requires more dispersant.

In order to achieve appropriate melt-out of the release agent and a proper balance between fixation property and transparency, the release agent is preferably rod-shaped and has a volume average particle size falling within the range of 200 to 1500 nm. More preferably, the volume average particle size falls within the range of 250 to 1000 nm. If the particle size is smaller than 200 nm, the release agent may fail to adequately migrate during fixation even when melted, leading to insufficient image preservability. On the other hand, if the particle size exceeds 1500 nm, crystal particles having sizes which reflect visible light may remain within and/or on the surface of the image after fixation, deteriorating transparency with respect to light. The release agent specified as above preferably constitutes 75% or more of the total release agent content within the toner.

In addition to the above-noted components, inorganic or organic particles may be included in the magenta toner according to the preferred embodiment. By the reinforcing effect provided by those particles, storage elastic modulus of the toner can be increased, thereby possibly improving offset resistance and releasability from the fixation device. Further, the inorganic or organic particles may enhance dispersability of the toner components, such as the colorant and the release agent. Examples of inorganic particles that can be added include substances such as silica, hydrophobicized silica, alumina, titanium oxide, calcium carbonate, magnesium carbonate, tricalcium phosphate, colloidal silica, alumina-treated colloidal silica, colloidal silica having cation-treated surface, and colloidal silica having anion-treated surface. These inorganic particles may be used as a single entity or in combination. Among those listed above, colloidal silica is preferred, in consideration of OHP transparency and dispersibility within the toner. The particle size of the inorganic or organic particles is preferably such that the volume average particle size falls within the range of 5 to 50 nm. particles having different particle sizes may be employed in combination. Although the inorganic or organic particles may be added directly to the mixture during toner fabrication, in order to increase dispersibility, before addition these particles are preferably dispersed in an aqueous solvent such as water by means of an ultrasonic disperser or the like. When these particles are dispersed, agents such as an ionic surfactant, polymeric acid, and polymeric base may be used to promote dispersion.

When the above-described aggregation fusion method is employed, a flocculent may be added in order to aggregate the components, such as the resin particles and the colorant particles. The flocculent can be obtained by dissolving a typical inorganic metal compound or its polymer within the resin-particle-dispersed liquid. The metal element constituting the inorganic metal salt belongs to Group 2A, 3A, 4A, 5A, 6A, 7A, 8, 1B, 2B, or 3B in the periodic table (extended periodic table), has a valence of 2 or higher, and dissolves in the resin particle aggregation system in the form of an ion. Specific examples of preferred inorganic metal salts include calcium chloride, calcium nitrate, barium chloride, magnesium chloride, zinc chloride, aluminum chloride, and aluminum sulfate. Specific examples of preferred inorganic metal salt polymers include poly(aluminum chloride), poly(aluminum hydroxide), and calcium polysulfide. Among those listed above, an aluminum salt and its polymer are particularly preferred. In general, in order to attain a narrower particle distribution, an inorganic salt having a higher valence is more appropriate as the flocculant. That is, a valence of 2 is more appropriate than 1, and a valence of 3 or higher is more appropriate than 2. Among inorganic salts having the same valence, inorganic metal salt polymers which are of a polymerizing type are more preferred as the flocculent. In view that the flocculative property between the toner components can be adjusted by the valence and addition amount of the flocculant to thereby control the toner viscoelasticity, the flocculent is preferably added to the toner according to the present invention. A single type of flocculent may be employed, or two or more types can be used in combination.

The magenta toner of the preferred embodiment has a shape factor SF1 within the range of 115 to 140. If the shape factor SF1 is below 115, adhesion between the toner particles become weak, such that scattering of the toner may occur during transfer. If the shape factor SF1 exceeds 140, transferability may degrade, and toner density in the developed image may be lowered. The shape factor SF1 referred to herein is given by the following equation:

$$SF1=(ML^2/A)\cdot(\pi/4)\cdot 100$$

wherein ML denotes the absolute maximum length of the toner particle, and A denotes the projected area of the toner particle. The SF1 value can be typically obtained by analyzing, by means of an image analyzer, an image of the toner captured by a microscope or scanning electron microscope (SEM) as described below, for example. An optical microscopic image of a toner sprayed on a slide glass is input via a video camera into a LUZEX image analyzer. In the analyzer, the maximum length and projected area are determined for more than 200 particles of the toner. Using the determined values, the calculation according to the above equation is performed for each particle. An average of the calculated values is determined, to finally obtain the SF1 value for the toner. The shape factor SF1 according to the present invention is calculated by analyzing, by means of a LUZEX image analyzer, an image captured by an optical microscope.

Other known materials such as a charge control agent may be added to the magenta toner of the preferred embodiment. The volume average particle size of the added material must be no greater than 1 μm, and preferably falls within the range of 0.01 to 1 μm. If the volume average particle size exceeds 1 μm, the particle size distribution of the final-product electrostatic latent image developing toner may become wide, and free particles may be generated in the toner, leading to degradation of performance and reliability of the toner. When the volume average particle size of the added material falls within the above-specified range, such disadvantages can be avoided. In addition, maldistribution of the material within the toner can be minimized. By achieving favorable distribution within the toner, variances in performance and reliability of the toner can be reduced. The volume average particle size of the added material can be measured by means of MICROTRAC.

No particular limitations are imposed on preparation of dispersed liquids containing various added materials noted above. For example, the colorant-dispersed liquid and the release-agent-dispersed liquid may be prepared by means of known dispersing devices such as a rotary-shear-type homogenizer; a media-type disperser such as a ball mill, sand mill, or DYNO-MILL; or any other device. An appropriate type of disperser can be selected in accordance with needs.

The absolute charge amount of the magenta toner according to the embodiment preferably falls within the range of 10 to 70 μC/g, and more preferably within the range of 15 to 50 μC/g. If the charge amount is below 10 μC/g, background contamination tends to occur. If the charge amount exceeds 70 μC/g, image density is likely to decrease. Further, the ratio of the charge amount under high humidity of 80RH % at 30° C. to the charge amount under low humidity of 20RH % at 10° C. preferably falls within the range of 0.5 to 1.5, more preferably within the range of 0.7 to 1.2. When this ratio falls within the specified range, a high-definition image can be produced without being influenced by the surrounding environment. Although external additives exert a great influence on the charge amount of the toner, the charge amount without external additives appears to be significant. In order to attain desirable values of charge amount and above-described environmental charge ratio of the toner without external additives, the acid value of the main binder resin preferably falls within the range of 5 to 50 mgKOH/g, more preferably within the range of 10 to 40 mgKOH/g. The acid value (hydroxyl value) of the binder is determined according to the titration method defined by JIS K 8006. In relation to control of the toner charge amount, efforts should be made to minimize the total amount of surfactant used in various dispersed liquids such as the colorant-dispersed liquid and the release-agent-dispersed liquid, and residual surfactant and ions should be sufficiently cleansed off. The cleansing is preferably carried out until the conductivity of the cleansing filtrate reaches 0.01 mS/cm or lower. Furthermore, drying of the toner is also important. The toner is preferably dried until the amount of moisture in the toner is 0.5 wt % or less.

The magenta toner according to the embodiment is preferably such that the molecular weight distribution denoted by the ratio (Mw/Mn) of weight average molecular weight (Mw) to number average molecular weight (Mn) as measured by gel permeation chromatography falls within the range of 2 to 30, more preferably within the range of 2 to 20, and further preferably within the range of 2.3 to 5. If the toner molecular weight distribution denoted by the ratio (Mw/Mn) exceeds 30, optical transparency and coloring property are insufficient. If an image is developed and fixed on a film by means of an electrostatic latent image developing toner having such a high Mw/Mn value, a projected image obtained by transmitting light through the image on the film may become dark and obscure. Even worse, the projected image may be colorless without optical transmission. If the Mw/Mn value is below 2, the toner viscosity becomes drastically low during fixation at a high temperature, such that hot offset may occur. When the toner molecular weight distribution denoted by the ratio (Mw/Mn) falls within the above-specified range, sufficient optical transparency and coloring property can be attained. Further, decrease in viscosity of the electrostatic latent image developing toner during fixation at high temperature can be prevented, thereby effectively minimizing generation of hot offset.

After the final heating process is performed as described above, inorganic and/or organic particles may be added to the magenta toner as a fluidity improver, cleaning auxiliary, polishing agent, or the like. Examples of the inorganic particles include silica, alumina, titania, calcium carbonate, magnesium carbonate, tricalcium phosphate, cerium oxide, and all other inorganic particles which are typically used as external additives applied to a toner surface. These inorganic particles are used to control various toner characteristics such as charging property, powder characteristic, and preservability, and to optimize toner performance within a system, such as developing property and transferability. Examples of the organic particles include vinyl-based resins such as styrene-based polymers, acrylic or methacrylic polymers, and ethylene-based polymers; polyester resins; silicone resins; fluorine-based resins; and all other organic particles which are typically used as external additives applied to a toner surface. These organic particles are added for the purpose of enhancing transferability, and preferably have a primary particle size falling within the range of 0.05 to 1.0 μm. In addition, a lubricant may be added to the toner. Examples of lubricants include fatty acid amides such as ethylene bis-stearamide and oleamide; fatty acid metal salts such as zinc stearate and calcium stearate; and higher alcohols such as UNILIN alcohols. These lubricants are added to the toner generally for the purpose of promoting cleaning, and may have a primary particle size falling within a range of 0.1 to 5.0 μm. Preferably, hydrophobicized silica, which is a type of inorganic particle, is added as an essential component to the toner according to the present invention. The inorganic particles preferably have a primary particle size falling within a range of 0.005 to 0.5 μm. Particularly preferably, silica-based particles and titanium-based particles are used in combination. Furthermore, in consideration of transferability and developer life, inorganic or organic particles having a volume average particle size within the range of 80 to 300 nm are preferably employed.

Known materials may be used as a hydrophobicizing agent for hydrophobicizing an external additive. Examples thereof include couplers such as a silane-based coupler, titanate-based coupler, aluminate-based coupler, or zirconium-based coupler; silicone oil; and polymer coating. These hydrophobicizing agents may be used singly or in combination of two or more. Among those listed above, a silane-based coupler and silicone oil are favorably employed. Any type of silane-based coupler may be used, including chlorosilane, alkoxysilane, silazane, and specific silylant agent. Specific examples of silane-based couplers include, but are not limited to, methyltrichlrosilane, dimethyldichlrosilane, trimethylchlrosilane, phenyltrichlrosilane, diphenyldichlrosilane, tetramethoxysilane, methyltrimethoxysilane, dimethyldimethoxysilane, ethyltrimethoxysilane, propyltrimethoxysilane, phenyltrimethoxysilane, diphenyldimethoxysilane, tetraethoxysilane, methyltriethoxysilane, dimethyldiethoxysilane, ethyltriethoxysilane, propyltriethoxysilane, phenyltriethoxysilane, diphenyldiethoxysilane, butyltrimethoxysilane, butyltriethoxysilane, isobutyltrimethoxysilane, hexyltrimethoxysilane, octyltrimethoxysilane, decyltrimethoxysilane, hexadecyltrimethoxysilane, trimethyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, vinyltriacetoxysilane, γ-methacryloxypropyltrimethoxysilane, β-(3,4-epoxycyclohexyl)ethyltrimethoxysilane, γ-glycydoxypropyltrimethoxysilane, γ-glycydoxypropyltriethoxysilane, γ-glycydoxypropylmethyldiethoxysilane, γ-mercaptopropyltrimethoxysilane, and γ-chloropropyltrimethoxysilane. Examples of silane-based couplers further include fluorine-based silane compounds obtained by partially substituting the hydrogen atoms in the above-listed silane-based couplers with fluorine atoms, such as trifluoropropyltrimethoxysilane, tridecafluorooctyltrimethoxysilane, heptadecafluorodecyltrimethoxysilane, heptadecafluorodecylmethyldimethoxysilane, tridecafluoro-1,1,2,2-tetrahydrooctyltriethoxysilane, 3,3,3-trifluoropropyltrimethoxysilane, heptadecafluoro-1,1,2,2-tetrahydrodecyltriethoxysilane, and 3-heptafluoroisopropoxypropyltriethoxysilane. Examples of silane-based couplers also include amino-based silane compounds obtained by partially substituting the hydrogen atoms in the above-listed silane-based couplers with amino groups.

Examples of silicone oil include, but are not limited to, dimethyl silicone oil, methylhydrogen silicone oil, methylphenyl silicone oil, cyclic dimethyl silicone oil, epoxy-modified silicone oil, carboxyl-modified silicone oil, carbinol-modified silicone oil, methacryl-modified silicone oil, mercapto-modified silicone oil, polyether-modified silicone oil, methylstyryl-modified silicone oil, alkyl-modified silicone oil, amino-modified silicone oil, and fluorine-modified silicone oil. By hydrophobicizing the particles used for the toner, charging property under high humidity can be improved, thereby enhancing the environmental stability of toner charges. According to the present invention, the toner preferably includes at least one type of external additive which is hydrophobicized by a silicone oil.

Conventionally known methods for hydrophobicizing the particles can be employed. In one known method, the hydrophobicizing agent is mixed in and diluted with a solvent such as tetrahydrofran, toluene, ethyl acetate, methyl ethyl ketone, or acetone. The diluted hydrophobicizing agent is titrated or sprayed into the particles which are forcedly agitated by means of a blender or the like, thereby sufficiently mixing in the hydrophobicizing agent. The particles are subsequently cleansed and filtered in accordance with needs, then dried by heating. The dried aggregates are pulverized by means of a blender or in a mortar to obtain the final hydrophobicized particles. According to another hydrophobicizing method, the particles to be treated are immersed in a hydrophobicizing agent solution and then dried. Alternatively, the particles to be treated are dispersed in water to prepare a slurry, then a hydrophobicizing agent solution is titrated into the slurry. Subsequently, the particles are allowed to precipitate, dried by heating, and pulverized. According to yet another hydrophobicizing method, a hydrophobicizing agent may be sprayed directly onto the particles. The amount of the hydrophobicizing agent applied on the particles preferably falls within the range of 0.01 to 50 wt % of the particles, more preferably within the range of 0.1 to 25 wt %. The amount of application can be adjusted by increasing the mixing amount of the hydrophobicizing agent, changing the number of cleansing steps after the hydrophobicizing step, and the like. The amount of applied hydrophobicizing agent can be quantitatively analyzed by X-ray diffraction (XPS) or elementary analysis. If the amount of applied hydrophobicizing agent is too small, charging property under high humidity may be degraded. If the amount of applied hydrophobicizing agent is too large, excessive charging may occur under low humidity, and free hydrophobicizing agent may deteriorate powder fluidity of the developer.

The external additive particles may be attached or fixed onto the toner particle surface by being subjected to mechanical impact force together with the toner particles, by means of a sample mill or a Henschel mixer.

[Developer]

Although the magenta toner according to the preferred embodiment may be used as a single-component developer comprising the toner alone or as a two-component developer comprising the toner and a carrier, the magenta toner is preferably used as a two-component developer, in view of its advantages in charge sustainability and stability. A carrier used for the developer is preferably a carrier coated with resin, and more preferably a carrier coated with a nitrogen-containing resin.

Examples of the nitrogen-containing resin include acrylic resins which contain substances such as dimethylaminoethylmethacrylate, dimethylacrylamide, and acrylonitrile; amino resins which contain substances such as urea, urethane, melamine, guanamine, and aniline; amide resins; urethane resins; and copolymer resins composed of the above-listed substances.

The resins for coating the carrier may be employed by combining two or more types of the above-listed nitrogen-containing resins. Further, a combination of a nitrogen-containing resin and a non-nitrogen-containing resin may be employed. The nitrogen-containing resin may be fabricated in the form of particles, and used by dispersing the particles within a non-nitrogen-containing resin. In particular, urea resin, urethane resin, melamine resin, guanamine resin, and amide resin are preferred, in view of their high positive charging property and high resin hardness. The high resin hardness prevents peeling of the coating resin, thereby minimizing reduction in charge amount caused by such peeling.

Furthermore, in order to enhance reliability, the resin coating layer preferably includes acrylic or methacrylic acid alkyl ester which contains an alkyl group having a branched structure. By incorporation of an acrylic or methacrylic acid alkyl ester having a branched alkyl group, a favorable balance between adhesive power and surface contamination resistance can be achieved at a high level. If the branched alkyl group has only 3 or fewer carbon atoms, the above-noted characteristic cannot be achieved. If the number of carbon atoms in the branched alkyl group exceeds 20, the polymer becomes physically fragile. Further, the polymer would be inappropriate as a coating material, because the coated film would be too soft and would therefore negatively affect carrier preservability and fluidity. Accordingly, it is desirable to use the above-specified polymer in which the number of carbon atoms in the branched alkyl group is 4 to 20, and which can appropriately function as a coating material. Specific examples of the acrylic or methacrylic acid alkyl esters containing a branched alkyl group include those in which one or more alkyl (such as methyl) substitution is present in the carbon chain of the ester portion, such as tertiary butyl acrylate or methacrylate, isobutyl acrylate or methacrylate, sec-butyl acrylate or methacrylate, neo-pentyl acrylate or methacrylate, isopentyl acrylate or methacrylate. Further, in combination with the above substances, there may be used acrylic or methacrylic acid alkyl esters having a fluorine-containing alkyl group. The fluorine-containing alkyl groups serve to reduce the surface energy of the coating resin, thereby preventing toner adhesion to the charging device components and the carrier. No particular limitations are imposed on the fluorine-containing alkyl groups that can be used, and they may be appropriately selected in consideration of the balance between the ability to provide carrier surface contamination resistance and the softness of the obtained coated film. Specific examples of the acrylic or methacrylic acid alkyl esters having a fluorine-containing alkyl group include trifluoroethyl acrylate or methacrylate, tetrafluoroethyl acrylate or methacrylate, perfluoropentyl acrylate or methacrylate, perfluoropentylethyl acrylate or methacrylate, perfluorooctyl acrylate or methacrylate, perfluorooctylethyl acrylate or methacrylate, and perfluorododecyl acrylate or methacrylate.

In general, a carrier should have a suitable electric resistance. Specifically, the electric resistance desirably falls within the range of approximately $10^8$-$10^{14}$ Ωcm. If the electric resistance value is low, on the order of $10^6$ Ωcm, such as when an iron powder carrier is used, the carrier may adhere to the imaging portion of the photosensitive member when charges are injected from the sleeve. Further, the latent image charges may dissipate via the carrier, raising problems such as disturbances in the latent image and defects in the resulting image. On the other hand, if an insulative resin is thickly coated on the carrier, electric resistance becomes excessively high. In such a case, although an image having sharp edges can be obtained, in view that carrier charges are unlikely to leak, a phenomenon referred to as the edge effect results, in which image density at a central portion of an image having a large area becomes drastically low. In order to adjust the carrier resistance, a conductive powder is preferably dispersed within the resin coating layer.

The carrier resistance is measured by a typical inter-plate electric resistance measurement method, in which carrier particles are placed between two electrode plates, and the electric current obtained under application of a voltage is measured. The resistance measured under an electric field of $10^{3.8}$ V/cm is evaluated.

The electric resistance of the conductive powder itself is preferably no higher than $10^8$ Ωcm, and more preferably no higher than $10^5$ Ωcm. Specific examples of the conductive powder include metals such as gold, silver, and copper; carbon black; single-component conductive metal oxides such as titanium oxide and zinc oxide; and composite materials obtained by coating, with a conductive metal oxide, the surfaces of particles such as titanium oxide, zinc oxide, aluminum borate, potassium titanate, or tin oxide. Carbon black is particularly preferred, in consideration of production stability, cost, and low electric resistance. No particular limitations are imposed on the types of carbon black that can be used, but a type having high production stability and DBP (dibutyl phthalate) oil absorbance within a range of 50 to 300 ml/100 g is preferred. The volume average particle size of the conductive powder is preferably no greater than 0.1 μm. For favorable dispersion, the volume average primary particle size is preferably no greater than 50 nm.

Example methods for forming a layer of the above-described resin coating on the surface of a carrier-core material include, for example, an immersion method in which the carrier core material powder is immersed in a solution prepared for forming the coating, a spray method in which the coating solution is sprayed on the carrier core material, a fluidized bed method in which the coating solution is sprayed while the carrier core material is suspended in flowing air, a kneading coater method in which the carrier core material and the coating solution are mixed in a kneading coater and then the solvent is removed, and a powder coating method in which pulverized coating resin is mixed with the carrier core material in a kneading coater at a temperature higher than the melting point of the coating resin, and then cooled so as to form the coating. In particular, the kneading coater method and the powder coating method are preferred.

The average film thickness of the resin coating layer formed by the above method typically falls within the range of 0.1 to 10 μm, and more preferably within the range of 0.2 to 5 μm.

No particular limitation is imposed on the core material used for the carrier (carrier core material) in the electrostatic latent image developer according to the preferred embodiment, and the core material may comprise a ferromagnetic metal such as iron, copper, nickel, or cobalt; magnetic oxides such as ferrite and magnetite; and glass beads. In view that a magnetic brush may be used in a copier, the carrier is preferably a magnetic carrier. The average particle size of the carrier core material typically falls within the range of 10 to 100 μm, and preferably within the range of 20 to 80 μm.

When producing a two-component developer, the electrostatic latent image developing magenta toner of the preferred embodiment and the above-described carrier are mixed at a ratio by weight (i.e., magenta toner:carrier) falling within the range of approximately 1:100 to 30:100, and more preferably within the range of approximately 3:100 to 20:100.

[Image Forming Method]

The magenta toner according to the preferred embodiment can be used for a xerographic process including a toner recycling step. The recycling step is a step in which the electrostatic latent image developing toner that was recovered during the cleaning step is transferred back to the developer layer. The toner according to the preferred embodiment can also be used in a device having a recycling system in which toner recovery is performed simultaneously with the developing step.

An image forming method according to the preferred embodiment comprises the steps of forming a latent image on a latent image carrier, developing the latent image by means of an electrostatic latent image developing toner, transferring the developed toner image onto a receiver with or without use of an intermediate transfer member, and fixing the toner image on the receiver by heating and pressurizing.

The fixation device used for fixing the toner in the fixation step may comprise a known contact-type heat fixation device. The fixation device may be, for example, a heat-roller-type fixation device comprising a heating roller and a pressurizing roller. Each of these rollers is composed of a resilient layer provided on a core rod, and, in accordance with needs, further includes a fixation surface layer. Alternatively, the combination of two rollers in the fixation device may be replaced with a combination of a roller and an endless belt, or a combination of two endless belts. The fixation device may further comprise, in accordance with needs, means for applying a releasant such as silicone oil. The main purpose of the releasant is not for separating the toner image from the fixation device components, but simply for preventing contaminants from adhering to the fixation device components. Accordingly, the releasant is applied in very small amounts.

As the core material of a fixation roll, a material having high heat resistance, high resistance to deformation, and high heat conductivity is selected. Examples include aluminum, iron, and copper. When the fixation device includes an endless belt, a material having high heat resistance and durability, such as polyimide film, polyamideimide film, or stainless steel belt, is selected as the belt core material.

A resilient layer is preferably provided on the core material. The resilient layer favorably conforms to unevenness in an image, thereby serving to enhance image flatness and to attain uniform melt-out of the release agent to the image surface. The resilient layer may be composed of a heat-resistant rubber such as silicone rubber or fluorine rubber. The rubber hardness preferably falls within the range of 10 to 80, in ASKER C hardness value. Insufficient-hardness would result in deficient durability. If the rubber is excessively hard, the roll would fail to sufficiently deform, such that fixation may fail to be adequately performed. The thickness of the resilient layer preferably falls within the range of 0.05 mm to 3.0 mm, and more preferably within the range of 0.1 mm to 2.0 mm. If the thickness is too small, the roll fails to sufficiently deform, such that fixation may fail to be adequately performed. If the resilient layer is excessively thick, the heating time becomes long, thereby degrading device efficiency.

As the fixation surface layer, materials such as silicone rubber, fluorine rubber, fluorine latex, and fluorine resin may be employed. Among these materials, fluorine resin enables reliable fixation performance over a long period of time. Fluorine resins that can be used as the fixation surface layer include Teflon (registered trademark) such as PFA (perfluoroalkoxyethylether copolymer), and soft fluorine resin such as vinylidene fluoride or the like. Compared to silicone rubber and fluorine rubber, a fluorine resin exhibits less deterioration in releasing property due to adhesion and deposits of toner contaminants. Accordingly, when the toner has sufficient releasing property, use of the fluorine resin as the fixation surface layer attains long life of the fixation component. The thickness of the fixation surface layer preferably falls within the range of 1.0 μm to 80 μm, and more preferably within the range of 15 μm to 50 μm. Insufficient thickness would result in deficient durability. If the thickness is excessive, the roll would fail to deform sufficiently, such that fixation may fail to be adequately performed. The fixation component (roll or belt) may include a number of additives for various purposes. For example, the fixation component may include carbon black, metal oxide, and ceramic particles such as SiC, for the purposes of improving abrasion resistance, controlling electric resistance, and the like.

According to the image forming method of the preferred embodiment, image preservability can be enhanced by fixing the toner of the present invention under an average nip pressure of 2.5 kgf/cm$^2$ or higher. Average nip pressure is a value calculated by F=A/D/N, wherein F (kgf/cm$^2$) denotes the average nip pressure during fixation, A (kgf) denotes total load applied on the fixation device, D (cm) denotes average fixation nip width, and N (cm) denotes length of the fixation nip along the axial direction of the roll.

Accordingly, the average nip pressure denotes an average value of the overall nip pressure. When the average nip pressure is high, the force pressing on the toner during fixation becomes large, enabling attainment of image glossiness within a relatively short period of time. However, if the fixation time is too short, among the release agent particles within the toner, only those having large domain sizes within the toner selectively melt out to the image surface, causing non-uniform melt-out of the release agent. On the other hand, if the average nip pressure is too low, fixation strength between the toner and the sheet may become insufficient. Therefore, the average nip pressure value is preferably no less than 0.5 kgf/cm$^2$. When a load exceeding 2.5 kgf/cm$^2$ is applied at a portion of the nip, the application time of such a large load is preferably limited to no greater than 45% of the entire nip time.

In order to perform fixation under the above-specified conditions, instead of using a pair of rollers, at least one of the rollers is preferably replaced with an endless belt component. More specifically, the fixation device may comprise a heating roller and an endless-belt-type pressurizing system. The heating roller may be formed as described above, by providing on the core material the resilient layer and the surface layer composed of fluorine resin. The pressurizing system may be configured such that pressure is applied by means of a pressurizing member from the inside of an endless belt composed of a material such as polyimide film. For example, a fixation device of this type disclosed in Japanese Patent Laid-Open Publication No. 2001-356625 may be employed. Alternatively, a fixation device as described in Japanese Patent Laid-Open Publication No. Hei 4-44074 may be used, in which the heating roll is replaced with an endless belt component. In this device, fixation is performed by providing a heating and pressuring member on the inside of an endless belt. However, according to this device, when a resilient layer is provided on the endless belt, heat capacity of the endless belt becomes too high, such that fixation speed cannot be increased easily. Accordingly, more preferably there is employed a fixation device in which the pressurizing component is composed of an endless belt.

The pressurizing component is preferably heated to a temperature lower than that of the heating roll or unheated.

The fixation temperature and speed are adjusted such that the value Gs(60) falls within the range of 10 and 60, as obtained by measuring, by the 60 degree specular gloss measurement method according to JIS Z 8741, the image surface gloss after the fixation step.

Although it may be the case that no releasant is applied to the fixation components, in consideration of durability and reliability, no problem should arise if a releasant is applied to a surface of at least one of the fixation components.

The amount of releasant applied to a fixation component preferably falls within the range of $1.6\times10^{-7}$ to $8.0\times10^{-4}$ mg/cm$^2$. A smaller amount of applied releasant is more desirable. If the supplied releasant amount exceeds $8.0\times10^{-4}$ mg/cm$^2$ (0.5 mg per A4-sized sheet), image quality would be degraded due to the releasant adhering on the image surface after fixation. This disadvantage is particularly noticeable when light is transmitted through the image in an OHP. The supplied releasant amount is measured by the following method. When a normal paper sheet (for example, a copy sheet model J Sheet manufactured by Fuji Xerox) used in a copier is passed between the fixation components having the releasant supplied on a surface, the releasant adheres on the paper sheet. The releasant on the paper sheet is extracted by means of a Soxhlet extractor. Hexane is used as the solvent. The amount of releasant adhering on the paper sheet can be determined by performing a quantitative analysis of the releasant included in hexane by means of an atomic absorption spectrochemical analyzer. The amount determined in this manner is used as the amount of releasant supplied to the fixation component.

No particular limitations are imposed on the releasant applied on the fixation component surface, and the releasant may be a liquid releasant including heat-resistant oil such as dimethyl silicone oil, fluorine oil, or fluorosilicone oil; or modified oils such as amino-modified silicone oil. In a conventional image forming method, use of fluorine oil or fluorosilicone oil is impractical, in view of cost, because the amount of supplied releasant cannot be reduced. In contrast, because the image forming method according to the present invention enables a drastic reduction in the amount of supplied releasant, fluorine oil and fluorosilicone oil can be practically used.

No particular limitations are imposed on the method for supplying the releasant. For example, a pad, web, or roller impregnated with the liquid releasant may be used for application, or the releasant may be supplied in a non-contacting shower (spray) method. Among the above, methods using a web or a roller are preferred because, according to these methods, the releasant can be uniformly supplied, and the supplied amount can be easily controlled. When the shower method is employed to supply the releasant, a blade or the like must be further employed in order to apply the releasant uniformly over the entire fixation component.

Although the receiver (recording material) to be used in the image forming method according to the present invention may be a normal paper sheet or OHP sheet used in typical xerographic copiers and printers, the advantages of the present invention can be fully realized particularly when surface smoothness of the receiver sheet falls within the range of 20 to 80 seconds, as in the case of recycled paper. Surface smoothness is measured according to JIS-P8119.

During preparation of the above-described colorant-dispersed liquid having a pigment dispersed therein, in order to control the average particle size of the colorant within the dispersed liquid, the colorant must be aggregated in desired particle sizes and dispersed within the aqueous medium (solvent) without precipitating or sedimenting. Furthermore, the colorant-dispersed liquid must be such that, when the colorant forms aggregate particles with the resin particles, the colorant particles do not aggregate with one another. A colorant-dispersed liquid satisfying these conditions is not readily prepared. If the average particle size of the colorant within the colorant-dispersed liquid is too large, various problems occur, including colorant precipitation and sedimentation, aggregation of colorant particles with one another with a coarse particle serving as a core, separation of the colorant during formation of aggregate particles with the resin particles, degradation in toner charging property due to exposure of the colorant to the toner surface, and deterioration of toner optical transparency due to the presence of coarse particles. Moreover, if the average particle size of the colorant within the colorant-dispersed liquid is too small, problems such as insufficient coloring property of the resulting toner result.

In light of the above, the colorant-dispersed liquid is preferably prepared as described below.

According to a preferred embodiment, a method for fabricating an electrostatic latent image developing toner includes a step of preparing an aggregate-particle-dispersed liquid by mixing a resin-particle-dispersed liquid prepared by dispersing resin particles with a colorant-dispersed liquid prepared by dispersing a colorant in an aqueous medium, and aggregating the resin particles and the colorant so as to form aggregate particles. The toner fabrication method further comprises a step of forming toner particles by heating and fusing the aggregate particles. In the above method, the colorant-dispersed liquid is preferably prepared by mixing the colorant with the aqueous medium in a mixing tank, transferring the mixture from the mixing tank to a dispersing tank via a primary dispersing device, and subsequently dispersing the mixture by means of a secondary dispersing device.

The secondary dispersing device is preferably a high-pressure disperser or an ultrasonic disperser.

Further, the entirety or a portion of the mixture is preferably recirculated back into the mixing tank after the mixture has passed through the primary dispersing device.

As shown in FIG. 1, two tanks are desirably provided, and the dispersed liquid is preferably transferred from one tank to the other tank, one or more times, by means of the secondary dispersing device. A batch-type dispersing device may be provided within the mixing tank.

Dispersion of the colorant in the aqueous medium can be performed by means of a known disperser such as a media-type disperser. Although a disperser can be selected in accordance with the type of colorant employed, according to the present invention, use of either an ultrasonic disperser or a high-pressure-impact-type disperser is preferred. During dispersion of the colorant in the aqueous medium, a binder resin may be added in addition to the colorant in order to attain an appropriate viscosity in the obtained slurry. If the slurry has an appropriate viscosity, a media-type disperser such as a sand mill or ball mill may be used to apply a sufficient shear force, such that the volume average particle size of the colorant within the colorant-dispersed liquid may be made no greater than 300 nm. However, if the colorant alone is dispersed, viscosity of the obtained slurry is low. In such a case, a media-type disperser may fail to apply a sufficient shear force, and attaining a dispersed colorant volume average particle size of no greater than 300 nm is not readily possible.

As such, when a media-type disperser is used for dispersing the colorant in the aqueous medium, the colorant may fail to be dispersed to desired particle sizes. Accordingly, if a media-type disperser is to be used, there must be selected a colorant which can be easily dispersed by a weak shear force. Such would limit the available variety of toner hues and the range of intermediate colors that can be reproduced. In order to disperse a non-easily dispersed colorant, a stronger shear force may be produced by employment of media having smaller diameters or by increasing the media fill factor. However, in that case, dispersion stability would not be sufficient, because a slurry almost always exhibits thixotropy under continuous and high shear. Consequently, the dispersed colorant volume average particle size of no greater than 300 nm cannot be achieved. Dispersion using a media-type disperser is also disadvantageous in that attaining a narrow colorant particle size distribution within the colorant-dispersed liquid is difficult. Further disadvantages in using a media-type disperser are that media fragments may contaminate the colorant-dispersed liquid, and that the dispersion time is long. As such, use of a media-type disperser is inconvenient because the above-described disadvantages must be avoided, and because of a requirement to optimize the type and amount of dispersant to be used and the mechanical dispersion conditions, such as media diameter and shear speed. In contrast, use of either an ultrasonic disperser or a high-pressure-impact-type disperser is preferable, in that the above problems do not arise.

However, when an ultrasonic disperser or a high-pressure-impact-type disperser is used, an appropriate pretreatment must be performed. Especially in large-scale fabrication, when the pretreatment is inappropriate, dispersion efficiency is degraded drastically, and clogging within the disperser may damage the device. The pretreatment comprises wet pulverization of aggregate lumps within the colorant into sufficient sizes. While the pulverization can be accomplished by means of a relatively weak force, any remaining-lumps cause clogging of the disperser. According to the preferred method of the present invention, this problem is solved by providing a mixing tank separately from a dispersing tank, and pulverizing all aggregate lumps within the liquid before introducing the liquid into the dispersing tank. In order to process powder materials and wet cakes introduced into the mixing tank, anchor wings and various large-sized wings can be favorably employed. If a foaming material such as a surfactant is added, anti-foaming measures must be taken. Although a batch-type dispersing device may be disposed within the mixing tank, in the preferred embodiment an inline-type primary dispersing device is provided externally. The pretreatment can be efficiently performed by executing a circulating operation in which the liquid processed by the primary dispersing device is supplied back into the mixing tank. It should be noted that colorant aggregate lumps adhere to the walls and agitators within the mixing tank. In order to prevent these aggregate lumps from entering the dispersing tank, the entire liquid must be passed through the primary dispersing device when the liquid is transferred to the dispersing tank.

By performing the above-described process, an ultrasonic disperser and a high-pressure-impact-type disperser which are preferable for obtaining finer dispersed particles can be stably operated without causing device clogging. Furthermore, load on the dispersers, which requires a large amount of energy, can be greatly reduced.

Because dispersion of the colorant within a colorant-dispersed liquid obtained as a result of the above-described method is very favorable, the colorant-dispersed liquid can be used not only in an electrostatic latent image developing toner, but in a wide variety of fields, including an aqueous ink and inkjet printing ink.

According to the preferred method described above, mixing of coarse colorant particles into the colorant-dispersed liquid can be almost completely prevented. As a result, optical transparency of the dispersed colorant within the toner can be enhanced, enabling production of a full-color image having high chrominance on an OHP film. Further, problems such as wide particle size distribution of the toner, exposure of the colorant particles to the toner surface, and separation of the colorant particles without forming aggregates with the resin particles can be avoided, thereby preventing degradation in performance and reliability. In summary, the toner can be used to fabricate an electrostatic latent image developing toner and an electrostatic latent image developer which are advantageous in terms of charging property, developing property, transferability, fixation property, easiness in cleaning, and particularly with respect to optical transparency and coloring property, enabling attainment of high image quality and reliability.

Another preferred embodiment of the method for fabricating an electrostatic latent image developing toner according to the present invention is described below.

The present method for fabricating an electrostatic latent image developing toner includes a step of preparing a mixture liquid by mixing at least the resin particles and the colorant particles, a step of aggregating the particles so as to form aggregate particles, and a step of fusing the aggregate particles. In the step of preparing the mixture liquid, a polymeric flocculant including a metal having a positive valence of 2 or greater is added to the mixture liquid, and subsequently, the mixture liquid is dispersed by means of a disperser including a rotor and a stator each having a plurality of slits. The disperser configuration and the executed dispersion are such that the following expressions are satisfied:

$$1.6\times10^7 \leqq F \leqq 6.0\times10^7$$

$$F=(v\cdot n\cdot K\cdot A)/(Q/3600)$$

wherein the symbols denote the following:

v(m/s): inner circumferential speed of the rotor slit located at the outermost periphery;

n(rotations): number of rotations per second (rpm/60);

K: value obtained by multiplying the number of outermost slit teeth on the rotor by the number of outermost slit teeth on the stator;

A($m^2$): total opening area of rotary slits at the outermost periphery; and

Q($m^3$/h): circulation flow rate.

The above-noted compound including a metal having a positive valence of 2 or greater is added during mixing of the particles such as the colorant. By subsequently dispersing the mixture liquid, the flocculant serves to reduce maldistribution of the particles. By performing the dispersion in the above-specified manner so as to ensure elimination of coarse particles, a toner having a narrow particle size distribution and a minimal amount of coarse particles can be fabricated. Furthermore, the workload and time conventionally required for elimination of coarse particles in a later stage of toner fabrication can be reduced.

Toner fabrication by means of an emulsion polymerization aggregation method is known. According to this method, a resin-dispersed liquid dispersed by an ionic surfactant is mixed with a pigment dispersed by another ionic surfactant having the opposite polarity. Hetero-aggregation is promoted by, for example, employing a flocculant for reducing repulsion between particles, and increasing surface energy by heating or the like, thereby forming aggregate particles having diameters of toner particles. Subsequently, the aggregate particles are fused to integrate the particle components. The fused particles are then cleansed and dried to obtain the final-product toner.

In this method, by selecting the heating temperature, the toner shape can be controlled over a range from a non-uniform shape to a sphere. Further, while both the colorant and the resin particles tend to exhibit negative polarity, aggregate particles can still be formed by adding a compound including a metal having a positive charge.

Concerning the compound including a metal having a positive charge, the rate at which the compound forms aggregate particles is greater than the rate at which the compound diffuses within the tank when being added. Therefore, the compound tends to form excessively large aggregate particles. Accordingly, the agitation conditions are optimized to increase the diffusion rate while minimizing maldistribution within the tank, thereby simultaneously suppressing generation of coarse particles and reducing excessively small aggregate particles produced at an initial stage of aggregate particle formation. In this manner, particle size distribution of the aggregate particles at an initial stage of aggregation can be controlled, and consequently, the particle size distribution of the grown aggregate particles can be controlled. As a result, a narrow particle size distribution can be achieved in the resulting toner.

A preferred embodiment of the toner fabrication method according to the present invention is illustrated in FIGS. 2-5. In the present method, a loop duct is provided such that the mixture liquid at the bottom portion of an agitation tank can be circulated back to the tank top portion. In accordance with needs, a pump is disposed within the loop to circulate the mixture liquid. While performing circulation in this manner, a rotor-stator disperser having a plurality of slits is used to execute dispersion. The dispersion is effected by the shear force generated by high-speed rotation of the rotor with respect to the stator, and by the differential pressure or cavitation generated when the slits of the rotor and the stator are placed in open and closed positions with respect to one another. The present inventors determined that this type of disperser can be used to produce an aggregate-dispersed liquid having a narrow particle size distribution and a volume average particle size between approximately 0.5 μm and 5 μm when $F=(v\cdot n\cdot K\cdot A)/(Q/3600)$ and $1.6\times10^7 \leqq F \leqq 6.0\times10^7$ are satisfied, wherein v(m/s) denotes the inner circumferential speed of the rotor slit located at the outermost periphery, n(rpm/60) denotes the number of rotations per second, K denotes a value obtained by multiplying the number of outermost slit teeth on the rotor by the number of outermost slit teeth on the stator, $A(m^2)$ denotes the total opening area of rotary slits at the outermost periphery, and $Q(m^3/h)$ denotes the circulation flow rate.

In order to prevent aggregate particles from growing excessively large, the temperature of the mixture liquid is preferably maintained within the range of 10° C. to 353° C., and more preferably within the range of 20° C. to 30° C. The temperature generally increases by shear, which further promotes aggregation of aggregate particles, possibly causing generation of coarse particles. In order to avoid this, the temperature of the mixture liquid is desirably maintained low. As cooling means for use during the dispersion process, a cooling jacket having cooling water circulating therein may be provided on any one or a combination of the agitation tank, recirculation loop, and disperser.

Before fusing the aggregate particles by heating, a separate batch of resin particles may be added to attach those resin particles to the surface of the aggregate particles. After the attaching step, the aggregate particles may be heated and fused. In this manner, a desired layered structure can be formed in the radial direction of the toner particles. By means of this approach, the toner surface can be coated with a resin or a charge controller, and a wax or a pigment can be positioned near the toner surface.

The components to be used for fabricating a magenta toner according to the present method are the same as those described above.

Next will be described a method and apparatus for eliminating coarse particles from the slurry of colorant and resin particles prepared according to the above-described wet fabrication method for manufacturing toner.

In a xerographic toner fabrication method including a process of eliminating coarse particles within the slurry of colorant and resin particles by means of a sieve, the sieve is preferably an oscillating sieve. The mesh size of a screen employed in the sieve preferably falls within the range of 10 to 32 μm. The screen tension preferably falls within the range of 5 to 20 N/cm.

In a xerographic toner fabrication method including a process of eliminating coarse particles within the slurry of colorant and resin particles by means of an oscillating sieve, the screening process is preferably performed under the following conditions:

$$20 \leqq H \leqq 80$$

$$1.4 \leqq (a^2+b^2)^{0.5} \leqq 8.5$$

wherein H denotes oscillation frequency ($s^{-1}$), a denotes oscillation amplitude (mm) in the vertical direction with respect to the screen provided on the sieve frame, and b denotes oscillation amplitude (mm) in the horizontal direction with respect to the screen provided on the sieve frame.

The screening of the slurry can be performed by means of an oscillating sieve such as an electromagnetic oscillating sieve, a sieve operated by an oscillation motor, or a circular oscillating sieve. The screening can be favorably performed during or after fusing (polymerization) of the toner particles in an emulsion polymerization aggregation method or suspension polymerization method for fabricating a toner. When screening is performed during toner fusion, the slurry is circulated to eliminate coarse particles while the aggregate particles are being fused. Screening after toner fusion includes performing screening with respect to a slurry obtained at any point after fusing of the aggregate particles formed by an emulsion polymerization aggregation method or suspension polymerization method. For example, screening may be performed on a slurry obtained after the aggregate particles are fused and cleansed.

According to the present embodiment, the mesh size of the screen employed in the sieve is preferably no greater than three times the toner particle size (3D50v). Because effectively eliminating coarse particles from toners having small particle sizes of no greater than 8 μm is particularly desired, the mesh size preferably falls within the range of 10 to 32 μm, and more preferably within the range of 15 to 25 μm. If the mesh size is smaller than 10 μm, fabrication of the screen itself is difficult, involving high cost. Furthermore, such a screen would eliminate not only coarse particles, but also particles having particle sizes within the range appropriate for the final-product toner, resulting in undesirable screening characteristics and lowering of product yield. On the other hand, if the mesh size exceeds 32 μm, coarse particles cannot be adequately eliminated.

Tension at which the screen is held on the sieve preferably falls within the range of 5 to 20 N/cm, and more preferably within the range of 8 to 15 N/cm.

If the screen tension is below 5N/cm, the screen sags under the weight of the slurry, causing the slurry to accumulate on the screen. In such a case, oscillations generated by the oscillating sieve are not sufficiently transmitted to the screen, and consequently toner components within the slurry cannot be properly passed through the screen. As a result, a cake layer forms on the screen, blocking any further screening.

On the other hand, if the screen tension is greater than 20 N/cm, oscillations would be transmitted excessively. As a result, coarse particles having particle sizes closely similar (almost identical) to the screen mesh size would often be forced into the screen meshes, causing clogging which blocks toner components from passing through the screen. Further, because the slurry includes a surfactant, excessive transmission of oscillations results in foaming on the screen surface, blocking passage through the screen.

The tension can be measured by means of devices such as a tension gauge or tension meter. No particular limitations are imposed on the device use to measure screen tension, so long as the desired range of screen tension can be measured.

The oscillation frequency H of the sieve preferably falls within the range of 20 ($s^{-1}$) to 80 ($s^{-1}$). The oscillation amplitude given by "sqrt($a^2$+$b^2$)" should fall within the range of 1.4 to 8.5, and more preferably within the range of 2.5 to 8.5. Here, "sqrt" denotes square root, "a" denotes oscillation amplitude (mm) in the vertical direction with respect to the sieve frame, and "b" denotes oscillation amplitude (mm) in the horizontal direction with respect to the sieve frame.

If the sieve oscillation frequency falls below 20 ($s^{-1}$), sufficient force for passing the slurry through the sieve meshes cannot be obtained. This results in mesh clogging, such that screening cannot be continued. On the other hand, if the oscillation frequency exceeds 80 ($s^{-1}$), large acceleration would be applied to the sieve screen, leading to deformation and damage of the screen. In this case, screening cannot be stably performed over a long period of time.

If the oscillation amplitude "sqrt($a^2$+$b^2$)" falls below 1.4, oscillations are absorbed by the sieve screen and are not transmitted sufficiently, such that coarse particles placed on the screen cannot be forced to separate from the screen surface. As a result, clogging occurs, and screening cannot be performed stably. On the other hand, if the oscillation amplitude "sqrt($a^2$+$b^2$)" exceeds 8.5, coarse particles having particle sizes closely similar to the screen mesh size are often forced into the screen meshes. As a result, clogging occurs, and screening cannot be performed stably.

The screen employed for the sieve according to the present method may be a screen composed of resin such as nylon, polyester, and polypropylene; or a screen composed of a metal such as stainless steel.

The screen having a small mesh size used for the present method may be disposed in combination, in an overlapping manner, with a screen (protective screen) having larger fiber diameter and coarser mesh size, so as to enhance screen strength. The mesh size of the protective screen preferably falls within the range of approximately 300 to 3000 μm. The material of the protective screen may be the same as or different from that of the small-mesh screen. When the small-mesh screen is made of an elastic material such as nylon, the screen is preferably used in combination with a polyester screen, a polypropylene screen, a metal screen, or a perforated metal sheet.

A preferred embodiment of the present invention will next be described with reference to the drawings. Components labeled with identical reference numerals in different drawings have the same function, and therefore, repeated explanations of these components may be omitted.

Figure 6:
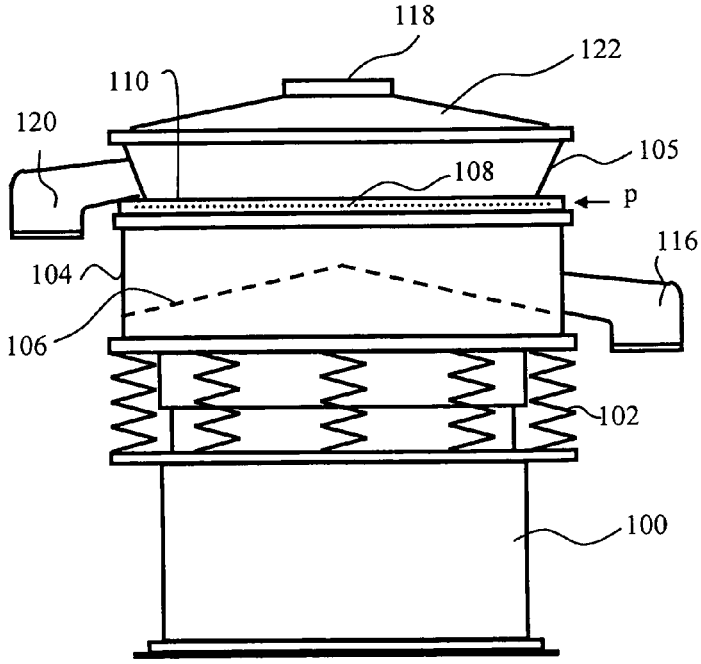
FIG. 6 is a schematic structural view showing an example oscillating sieve used in the present invention.

FIG. 6 is a schematic structural view showing an example oscillating sieve used in the present invention. In FIG. 6, a cylindrical sieve frame 104 is supported by a plurality of coil springs 102 on a base frame 100. Formed on the inside the sieve frame 104 is a conical or sloped bottom portion 106 depicted by broken lines in FIG. 6. Further, an annular support frame 110 on which a sieve screen 108 is held in tension is fixed on the sieve frame 104. An oscillation motor (not shown in FIG. 6) is provided inside the base frame 100. The entire sieve frame supported on the coil springs 102 is oscillated by the operation of the oscillation motor. A rotatable shaft (not shown) coupled to the oscillation motor provided inside the base frame 100 is connected to a lower portion of the bottom portion 106. Upper and lower unbalanced weights each having a center of gravity shifted from the shaft center are provided on the upper end and the lower end of the shaft, respectively. The coil springs 102 serve to absorb undesired oscillations of the oscillating sieve.

Figure 7:
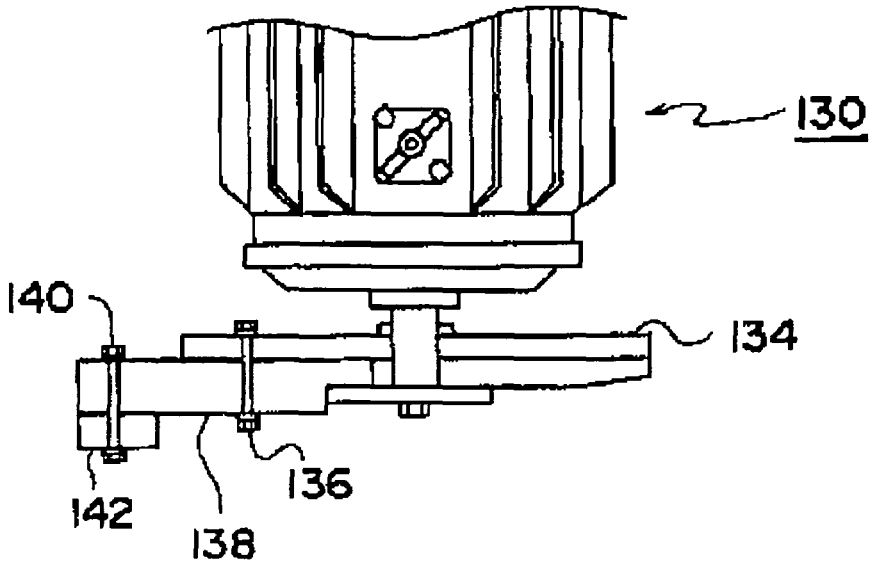
FIG. 7 is a diagram for explaining an essential portion of an oscillation motor appropriate for the present invention.
Figure 8:
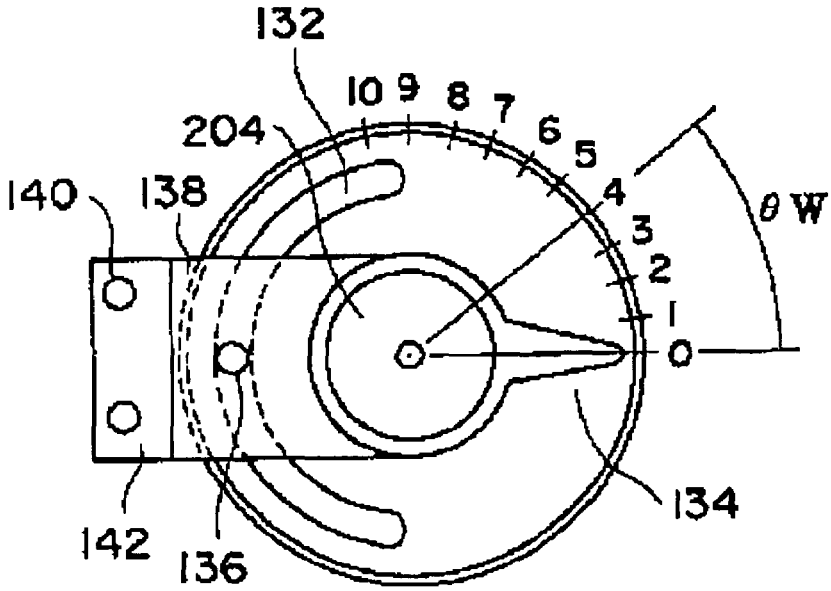
FIG. 8 is a diagram for explaining phase angles in an oscillation motor appropriate for the present invention.

FIGS. 7 and 8 schematically show a lower portion of an example oscillation motor provided inside the base frame 100. A weight-mounting plate 134 having an overall circular shape and an arcuate hole 132 is disposed on an output shaft 204 of the oscillation motor 130. A weight (unbalanced weight) 138 is fastened to the weight-mounting plate 134 by a weight-fastening bolt 136. The weight-fastening bolt 136 extends through the arcuate hole 132, so as to allow the weight 138 to be fixed at a desired angle with respect to the output shaft 204 of the oscillation motor 130 (so as to adjust the weight phase angle) An auxiliary weight 142 is removably attached to the weight 138 by a pair of weight-fastening bolts 140. Although not shown, on the rotatable shaft extending upward from the oscillation motor, an upper weight is mounted with its center of gravity shifted from the shaft center. By adjusting the weight phase angle between the upper and lower weights provided on the shafts coupled to the oscillation motor 130, oscillation behavior can be changed.

The internal surfaces of the device that come into contact with the particles are preferably buff-finished or coated with a composite coating. The composite coating film may contain particles. In particular, there are preferably used particles of a fluorine-containing compound which have favorable characteristics such as self-lubricity, low friction, water repellency, oil repellency, and non-adhesiveness. Although a fluorine-containing compound can be appropriately selected in accordance with needs, fluorinated graphite, fluorine resin, and fluorinated pitch are favorable examples.

In order to achieve oscillations such that the slurry is urged toward the center (or toward the periphery) on the sieve screen 108 shown in FIG. 6, the oscillation motor 130 is preferably controlled as described below. When the weight phase angle θw is set to 0° as shown in FIG. 8, a material placed at the center of the sieve screen 108 moves straight toward the periphery. By increasing the weight phase angle θw, rotational component is added to the movement of the material on the sieve screen 108. When the weight phase angle θw exceeds approximately 40°, the material on the sieve screen 108 is urged to flow toward the center. Accordingly, in the embodiment shown in FIG. 6 in which a coarse particle outlet 120 is provided on the outer peripheral surface of an upper frame 105 (so as to allow natural discharge), the weight phase angle θw is desirably set between approximately 0 and 40°. By controlling in this manner, the slurry on the sieve screen 108 is urged to flow toward the periphery of the sieve screen 108. Although the phase angle of at least 40° is required to urge toward the center the material to be screened, if the phase angle exceeds 90°, the slurry to be screened is prevented from traveling on the peripheral portion of the screen surface. In this case, the entire screen would not be fully used to perform the screening, possibly resulting in degradation in throughput.

As shown in FIG. 8, the weight (grams) and the weight phase angle θw of the lower unbalanced weight 138 can be adjusted. The weight (grams) can be changed by replacing the unbalanced weight 138 and/or the auxiliary weight 142. By adjusting the weight (grams) and the weight phase angle θw, the oscillation behavior can be controlled, especially the oscillation amplitude. Further, the oscillation frequency during screening can be adjusted by changing the rotation speed of the oscillation motor 130. The oscillation motor 130 may be configured as a type connected directly to a shaft as shown in FIG. 7, or alternatively, as a type which transmits drive power indirectly by means of a belt.

In an oscillation sieve as shown in FIG. 6, the oscillation frequency can be adjusted by changing the power frequency of the oscillation motor. When the motor is of a belt type, the oscillation frequency can be adjusted by changing the ratio of the pulley which drives the belt.

Furthermore, by changing the weights (grams) of the upper and lower weights on the rotatable shaft, the horizontal and vertical oscillation amplitudes can be adjusted. Oscillations of the screen frame can be measured by attaching a typical oscillation measurement scale on a screen frame p and visually observing during oscillation. For more accurate measurement, a typical oscillometer having an appropriate measurement range can be mounted on the screen frame by means of a fixture.

The screening process performed by the above-described oscillating sieve will next be described by reference to FIG. 6.

After adjusting the rotational speed of the oscillation motor 130 and the weight (grams) and phase angle of the unbalanced weights as described above to attain the desired oscillation amplitudes and frequency, a particle-dispersed liquid (such as the slurry) is supplied into the device via an inlet 118. The particle-dispersed liquid is screened by the three-dimensional oscillations of the overall sieve device generated by the operation of the oscillation motor. Coarse particles are discharged from the coarse particle outlet 120. Particles pass through the sieve screen and slide down the bottom portion 106, so as to be discharged from a screened product retrieval outlet 116. In this manner, a slurry of particles having desired sizes is obtained within the sieve frame 104.

The internal surfaces of the sieve that come into contact with the liquid may be composed of a material such as stainless steel, buff-finished stainless steel, electropolished stainless steel, Teflon coating, plating, and glass lining.

Figure 9:
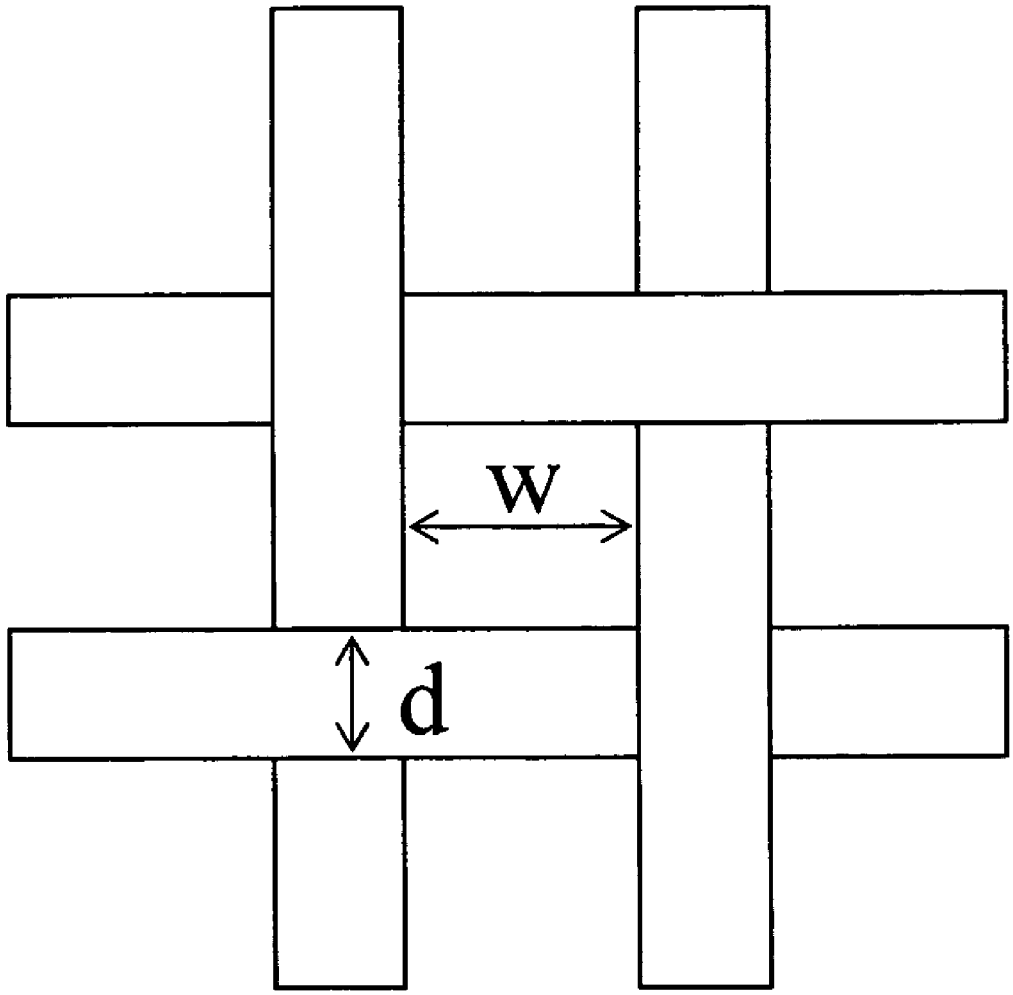
FIG. 9 is a diagram for explaining a screen appropriate for the present invention.

The screen may be woven, as shown in FIG. 9, in a typical weave pattern such as twilled weave, plain weave, or Ton-Cap weave. The screen may be calendered. Further, the screen may be a slit-type screen such as a wedge wire screen.

The particle-dispersed liquid or slurry may be supplied to the sieve in a continuous, intermittent, or pulsating manner. A pump used for transport may be a typical pump such as a centrifugal pump, a diaphragm pump, a plunger pump, a volute pump, a gear pump, a rotary pump, a tube pump, or a hose pump.

EXAMPLES

The present invention will now be described in detail below by reference to examples. It is to be understood that the examples are provided for purposes of illustration, and the invention is not limited to the examples.

In a method of manufacturing a toner according to examples and comparative examples, a resin-particle-dispersed liquid, a colorant—particle-dispersed liquid, and a release-agent—particle-dispersed liquid are prepared separately, and then, while these liquids are agitated/mixed in a predetermined proportion, a metallic salt flocculent is added for neutralization of liquid in terms of ions to form aggregate particles. Next, after pH is modified in a system from an acidulous range to a neutral range through the addition of an inorganic hydroxide, the system is heated to a temperature exceeding a glass transition point of the resin particles, so that the particles are fused and coalesced. Upon completion of reaction, a desired toner is obtained through a sufficient cleaning process and a solid-liquid separating and drying process. Individual preparation methods of the liquids will be described below.

<Preparation of Quinacridone Pigment 1>

A pigment of dimethyl quinacridone (a pigment red 122 having a volume average primary particle size $D_{50}$ Of 110 nm) manufactured by Dainichiseika Color & Chemicals Mtg. Co., Ltd. is used without modification; this pigment is hereinafter referred to as "quinacridone pigment A."

<Preparation of Quinacridone Pigment 2>

In a pressure kneader, 100 parts by weight of the dimethyl quinacridone (the pigment red 122 having a volume average primary particle size $D_{50}$ of 110 nm) manufactured by Dainichiseika Color & Chemicals Mtg. Co., Ltd., 500 parts by weight of a sodium sulfate, and 150 parts by weight of a diethylene glycol are introduced and preliminarily mixed until a uniform wetting substance is obtained. Then, after an internal pressure of the pressure kneader is set to 6 kg/cm$^2$, the preliminary mixture is pulverized for 5 hours while the inside of the pressure kneader is maintained at a temperature of 35° C. to 45° C. A pulverized product is fed into a 2% sulfate water solution having been heated to a temperature of 80° C., and is treated by the solution for 30 minutes. Subsequent to 30-minute treatment, the product is filtered and rinsed, and then vacuum-dried in an oven at a temperature of 40° C. to form the pigment of a finer particle size. The obtained pigment has a volume average primary particle size $D_{50}$ of 30 nm, and is hereinafter referred to as "quinacridone pigment B."

<Preparation of Naphthol Pigment 1>

By reference to manufacturing example 1 according to an embodiment described in Japanese Patent Laid-Open Publication No. Hei 11-272014, a naphthol pigment (a pigment red 238) is prepared. More specifically, 50 parts by mass (0.21 parts by mol) of 3-Amino-4-Methoxybenzanilide is dispersed into 1000 parts of mass of water, into which ice is added to set a temperature to 0° C. to 5° C. The resultant solution is agitated for 20 minutes after the addition of 60 parts by mass (0.58 parts by mol) of 35% HCl water solution, and then agitated for 60 minutes after the addition of 50 parts by mass (0.22 parts by mol) of 30% nitrite soda water solution. Subsequently, 2 parts by mass (0.02 parts by mol) of sulfamic acid are added to the solution to remove nitrite, and 50 parts by mass (0.37 parts by mol) of acetic acid soda and 75 parts by mass (1.12 parts by mol) of 90% acetic acid are further added to the solution, to thereby obtain a diazonium salt solution. Separately from this preparation, 68 parts by mass (0.21 parts by mol) of N-(5-chloro-2-methoxyphenyl)-3-hydroxy-2-naphthalenecarboxylic amide is dissolved in 1000 parts by mass of water in conjunction with 25 parts by mass (0.63 parts by mol) of caustic soda at a temperature of 80° C. or lower, to which 3 parts by mass (corresponding to 2.49 weight percent relative to the pigment) of minerite 100 is further added to obtain a coupler solution. The coupler solution is added to the above-described diazonium salt solution at a temperature of 10° C. or lower in order to induce a coupling reaction, and then treated by heat at 90° C. Subsequently, the resultant solution is filtered and rinsed, and then dried at a temperature of 100° C. Further, the resultant product having been dried is pulverized. As a result, 117 parts by mass (0.20 parts by mol) of a naphthol pigment is obtained. The obtained naphthol pigment has a volume average particle size $D_{50}$ of 70 nm. This pigment is hereinafter referred to as "naphthol pigment A."

<Preparation of Naphthol Pigment 2>

By reference to manufacturing example 1 according to the embodiment described in Japanese Patent Laid-Open Publication No. Hei 11-272014, a naphthol pigment (a pigment red 238) is prepared in a manner similar to that of the above-described preparation of naphthol pigment 1, except that the loading amount of the minerite 100 is changed to 2.2 parts by mass. A volume average primary particle size $D_{50}$ of the resultant pigment is 140 nm, and the pigment is hereinafter referred to as "naphthol pigment B."

| <Manufacture of Quinacridone-Pigment-Dispersed Liquid 1> | |
|---|---|
| Quinacridone pigment A ("PR122"; average primary particle size $D_{50}$: 110 nm) | 20 parts by mass |
| Anionic surfactant ("NEOGEN SC" manufactured by Dai-ichikogyo Seiyaku Co., Ltd. including, as active components, 10 weight percent of the anionic surfactant relative to the pigment) | 2 parts by mass |
| Ion-exchange water | 78 parts by mass |

Into a stainless vessel of such a size that liquid level is at a height almost equal to one-third the height of the vessel when all the above-listed components are introduced, 28 parts by mass of the ion-exchange water and 2 parts by mass of the anionic surfactant are provided. After the surfactant is sufficiently dissolved in the ion-exchange water, all the pigments are introduced into the vessel, and then agitated by means of an agitator until they are all moistened, and subsequently the resultant mixture is sufficiently degassed. Upon completion of degassing, the remaining ion-exchange water is added into the vessel and dispersed by means of a homogenizer ("ULTRA-TURRAX T50" manufactured by IKA Corporation) at 5000 rpm for 10 minutes, and a resultant mixture is then agitated by means of an agitator during one day and degassed. Subsequent to the degassing, the resultant mixture is further dispersed by means of the homogenizer at 6000 rpm for 10 minutes, and agitated again by means of the agitator during another one day, and then degassed. In the obtained dispersed liquid, the amount of precipitate is 12 weight percent, and the volume average primary particle size of the precipitate is 9 μm. Following the above treatment, the dispersed liquid is further dispersed by means of a high-pressure-impact-type disperser ("ULTIMIZER HJP30006" manufactured by Sugino Machine Ltd.) with 240 MPa of pressure. Dispersion is achieved by 25 passes of processing of ULTIMIZER as determined on the basis of total charge amount and throughput capability of the apparatus. After the obtained dispersed liquid is allowed to stand for 72 hours, supernatant fluid is collected, and ion-exchanged water is added to the collected fluid to adjust solid content in the fluid to 15 weight percent. An obtained pigment (colorant)—dispersed liquid obtained has a volume average primary particle size $D_{50}$ of 118 nm. The primary particle size $D_{50}$ is a mean value of three measurement values other than maximum and minimum values out of five measurement values obtained by means of the MICROTRAC.

| <Manufacture of Quinacridone-Pigment-Dispersed Liquid 2> | |
|---|---|
| Quinacridone pigment B ("PR122"; volume average primary particle size $D_{50}$: 30 nm) | 20 parts by mass |
| Anionic surfactant ("NEOGEN SC" manufactured by Dai-ichikogyo Seiyaku Co., Ltd. including, as active composition, 12 weight percent of anionic surfactant relative to the pigment) | 2.4 parts by mass |
| Ion-exchange water | 77.6 parts by mass |

Into a stainless vessel of such a size that liquid level is at a height almost equal to one-third the height of the vessel when all the above-listed components are introduced, 28 parts by mass of the ion-exchange water and 2.4 parts by mass of the anionic surfactant are provided. After the surfactant is sufficiently dissolved in the ion-exchange water, all the pigments are introduced into the vessel, then agitated by means of an agitator until they are all moistened, and the resultant mixture is then sufficiently degassed. Upon completion of degassing, the remaining ion-exchanged water is added into the vessel and dispersed by means of the homogenizer ("ULTRA-TURRAX T50" manufactured by IKA Corporation) at 5000 rpm for 10 minutes, and the resultant mixture is then agitated by means of the agitator during one day and degassed. Subsequent to the degassing, the resultant mixture is further dispersed by means of the homogenizer at 6000 rpm for 10 minutes, and agitated again by means of the agitator during another one day, and then degassed. In the obtained dispersed liquid, the amount of precipitate is 14 weight percent, and the volume average primary particle size of the precipitate is 8 μm. Following the above treatment, the dispersed liquid is further dispersed by means of the high-pressure-impact-type disperser ("ULTIMIZER HJP30006" manufactured by Sugino Machine Ltd.) with 240 MPa of pressure. The dispersion is achieved by 30 passes of processing of ULTIMIZER, as determined on the basis of total charge amount and throughput capability of the apparatus. After the obtained dispersed liquid is allowed to stand for 72 hours, supernatant fluid is collected, and ion-exchange water is added to the collected fluid to adjust solid content in the fluid to 15 weight percent. An obtained pigment (colorant)—dispersed liquid has a volume average primary particle size $D_{50}$ of 97 nm. The primary particle size $D_{50}$ is a mean value of three measurement values other than maximum and minimum values out of five measurement values obtained by means of the MICROTRAC.

| <Manufacturing of Quinacridone-Pigment-Dispersed Liquid 3> | |
|---|---|
| Quinacridone pigment B ("PR122"; volume average primary particle size $D_{50}$: 30 nm) | 100 parts by mass |
| X-24-9146 (manufactured by Shin-Etsu Chemical Co., Ltd.; active component = 2%) | 50 parts by mass |
| Toluene (manufactured by Wako Pure Chemical Industries, Ltd.) | 150 parts by mass |

The above components are placed into a flask and mixed for one hour. After one hour, pressure in the flask is reduced, and solvent is evaporated. The resultant product is left to stand at a temperature of 50° C. for one hour and then pulverized to obtain quinacridone pigment C. A quinacridone-pigment-dispersed liquid 3 is manufactured in a manner similar to that of the quinacridone-pigment-dispersed liquid 2, except that the quinacridone pigment C is used.

The obtained colorant dispersed liquid has a volume average primary particle size $D_{50}$ of 32 nm. The volume average primary particle size $D_{50}$ is a mean value of three measurement values other than maximum and minimum values out of five measurement values obtained by means of the MICROTRAC.

| <Manufacture of Naphthol-Pigment-Dispersed Liquid 1> | |
|---|---|
| Naphthol pigment A ("PR238"; volume average primary particle size $D_{50}$ = 70 nm) | 20.0 parts by mass |
| Anionic surfactant ("NEOGEN SC" manufactured by Dai-ichikogyo Seiyaku Co., Ltd. including, as active components, 10 weight percent of the anionic surfactant relative to the pigment) | 2.0 parts by mass |
| Ion-exchange water | 78.0 parts by mass |

Into a stainless vessel which is of such a size that liquid level is at a height almost equal to one-third the height of the vessel when all the above-listed components are introduced, 28 parts by mass of the ion-exchange water and 2 parts by mass of the anionic surfactant are provided. After the surfactant is sufficiently dissolved in the ion-exchange water, all the pigments are introduced into the vessel, then agitated by means of an agitator until they are all moistened, and the resultant mixture is then sufficiently degassed. Upon completion of degassing, the remaining ion-exchange water is added into the vessel and dispersed by use of the homogenizer ("ULTRA-TURRAX T50" manufactured by IKA Corporation) at 5000 rpm for 10 minutes, and the resultant mixture is then agitated by means of the agitator during one day and degassed. Subsequent to the degassing, the resultant mixture is further dispersed by means of the homogenizer at 6000 rpm for 12 minutes, and agitated again by means of the agitator during another one day, and then degassed. In the obtained dispersed liquid, the amount of precipitate is 18 weight percent, and the volume average primary particle size of the precipitate is 21 μm. Following the above treatment, the dispersed liquid is further dispersed by means of the high-pressure-impact-type disperser ("ULTIMIZER HJP30006" manufactured by Sugino Machine Ltd.) with 240 MPa of pressure. Dispersion is achieved by 30 passes of processing of ULTIMIZER, as determined on the basis of total charge amount and throughput capability of the apparatus. After the obtained dispersed liquid is allowed to stand for 72 hours, supernatant fluid is collected, and ion-exchange water is added to the collected fluid to adjust solid content in the fluid to 15 weight percent. An obtained pigment (colorant)-dispersed liquid has a volume average primary particle size $D_{50}$ of 112 nm. The primary particle size $D_{50}$ is a mean value of three measurement values other than maximum and minimum values out of five measurement values obtained by means of the MICROTRAC.

| <Manufacture of Naphthol-Pigment-Dispersed Liquid 2> | |
|---|---|
| Naphthol pigment A ("PR238"; average primary particle size $D_{50}$ = 140 nm) | 20.0 parts by mass |
| Anionic surfactant ("NEOGEN SC" manufactured by Dai-ichikogyo Seiyaku Co., Ltd. including, as active components, 10 weight percent of the anionic surfactant relative to the pigment) | 2.0 parts by mass |
| Ion-exchange water | 78.0 parts by mass |

Into a stainless vessel which is of such a size that liquid level is at a height almost equal to one-third the height of the vessel when all the above-listed components are introduced, 28 parts by mass of the ion-exchange water and 2 parts by mass of the anionic surfactant are provided. After the surfactant is sufficiently dissolved in the ion-exchange water, all the pigments are introduced into the vessel, then agitated by means of an agitator until they are all moistened, and the resultant mixture is then sufficiently degassed. Upon completion of degassing, the remaining ion-exchange water is added into the vessel and dispersed by means of the homogenizer ("ULTRA-TURRAX T50" manufactured by IKA Corporation) at 5000 rpm for 10 minutes, and a resultant mixture is then agitated by means of the agitator during one day and degassed. Subsequent to the degassing, the resultant mixture is further dispersed by means of the homogenizer at 6000 rpm for 12 minutes, and agitated again by means of the agitator during another one day, and then degassed. In the obtained dispersed liquid, the amount of precipitate is 16 weight percent, and the volume average primary particle size of the precipitate is 23 μm. Following the above treatment, the dispersed liquid is further dispersed by means of the high-pressure-impact-type disperser ("ULTIMIZER HJP30006" manufactured by Sugino Machine Ltd.) with 240 MPa of pressure. Dispersion is achieved by 25 passes of processing of ULTIMIZER, as determined on the basis of total charge amount and throughput capability of the apparatus. After the obtained dispersed liquid is allowed to stand for 72 hours, supernatant fluid is collected, and ion-exchange water is added to the collected fluid to adjust solid content in the fluid to 15 weight percent. A pigment (colorant)-dispersed liquid obtained has a volume average primary particle size $D_{50}$ of 195 nm. The primary particle size $D_{50}$ is a mean value of three measurement values other than maximum and minimum values out of five measurement values obtained by means of the MICROTRAC.

| <Manufacture of Naphthol-Pigment-Dispersed Liquid 1> | |
|---|---|
| Naphthol pigment A ("PR238"; volume average primary particle size $D_{50}$ = 140 nm) | 20.0 parts by mass |
| Anionic surfactant ("NEOGEN SC" manufactured by Dai-ichikogyo Seiyaku Co., Ltd. including, as active components, 10 weight percent of the anionic surfactant relative to the pigment) | 2.0 parts by mass |
| Ion-exchange water | 78.0 parts by mass |

Into a stainless vessel which is of such a size that liquid level is at a height almost equal to one-third the height of the vessel when all the above-listed components are introduced, 28 parts by mass of the ion-exchange water and 2 parts by mass of the anionic surfactant are provided. After the surfactant is sufficiently dissolved in the ion-exchange water, all the pigments are introduced into the vessel, then agitated by means of an agitator until they are all moistened, and the resultant mixture is then sufficiently degassed. Upon completion of degassing, the remaining ion-exchange water is added into the vessel and dispersed by means of the homogenizer ("ULTRA-TURRAX T50" manufactured by IKA Corporation) at 5000 rpm for 10 minutes, and the resultant mixture is then agitated by means of the agitator during one day and degassed. Subsequent to the degassing, the resultant mixture is further dispersed by means of the homogenizer at 6000 rpm for 12 minutes, and agitated again by means of the agitator during another one day, and then degassed. In the obtained dispersed liquid, the amount of precipitate is 16 weight percent, and the volume average primary particle size of the precipitate is 23 μm. Following the above treatment, the dispersed liquid is further dispersed by means of the high-pressure-impact-type disperser ("ULTIMIZER HJP30006" manufactured by Sugino Machine Ltd.) with 240 MPa of pressure. Dispersion is achieved by 20 passes of processing of ULTIMIZER, as determined on the basis of total charge amount and throughput capability of the apparatus. After the obtained dispersed liquid is allowed to stand for 72 hours, supernatant fluid is collected, and ion-exchange water is added to the collected fluid to adjust solid content in the fluid to 15 weight percent. An obtained pigment (colorant)-dispersed liquid has a volume average primary particle size $D_{50}$ of 275 nm. The primary particle size $D_{50}$ is a mean value of three measurement values other than maximum and minimum values out of five measurement values obtained by means of the MICROTRAC.

<Method of Manufacturing Resin—Particle-Dispersed Liquid>

<Measurement of Molecular Weight Distribution>

Molecular weight distribution of resin particles obtained according to the below-described manufacturing method is measured by means of apparatuses HLC-8120GPC and SC-8020 manufactured by Tosoh Corporation using columns of TSK gei and SuperHM-H (6.0 mm ID×15 cm×2) and using THF (tetrahydrofuran) as an eluent. Experimental conditions include specimen concentration of 0.5%, a flow rate of 0.6 ml/minute, an amount of sample infusion of 10 μl, and a measurement temperature of 40° C., and calibration curves are created from 10 samples, A-500, F-1, F-10, F-80, F-380, A-2500, F-4, F-40, F-128, and F-700. In addition, a data acquisition interval in specimen analysis is set to 30 ms.

Preparation of Resin—Particle-Dispersed Liquid (L1):

| | |
|---|---|
| **Oil Phase 1** | |
| Styrene (manufactured by Wako Pure Chemical Industries, Ltd.) | 15.3 parts by mass |
| n-butyl acrylate (manufactured by Wako Pure Chemical Industries, Ltd.) | 4.6 parts by mass |
| β-carbo-ethyle acrylate (manufactured by Rhodia Nicca) | 0.6 parts by mass |
| Dodecanethiol (manufactured by Wako Pure Chemical Industries, Ltd.) | 0.2 parts by mass |
| **Oil Phase 2** | |
| Styrene (manufactured by Wako Pure Chemical Industries, Ltd.) | 15.3 parts by mass |
| n-butyl acrylate (manufactured by Wako Pure Chemical Industries, Ltd.) | 4.6 parts by mass |
| β-carbo-ethyle acrylate (manufactured by Rhodia Nicca) | 0.6 parts by mass |
| Dodecanethiol (manufactured by Wako Pure Chemical Industries, Ltd.) | 0.4 parts by mass |
| **Water Phase 1** | |
| Ion-exchange water | 17.5 parts by mass |
| Anionic surfactant (manufactured by Rhodia) | 0.35 parts by mass |
| **Water Phase 2** | |
| Ion-exchange water | 40 parts by mass |
| Anionic surfactant (manufactured by Rhodia) | 0.05 parts by mass |

-continued

| | |
|---|---|
| Ammonium persulfate (manufactured by Wako Pure Chemical Industries, Ltd.) | 0.3 parts by mass |

The components described in the Oil Phase 1 and one-half the amount of components described in the Water Phase 1 are introduced into a flask and then mixed by agitation to produce a monomer-emulsion-dispersed liquid 1. Similarly, the components of the Oil Phase 2 and the remaining one-half of the amount of the components of the Water Phase 1 are mixed by agitation to produce a monomer-emulsion-dispersed liquid 2. The components of the Water Phase 2 are fed into a reaction vessel, and internal contents of the reaction vessel are sufficiently substituted with nitrogen. The reaction vessel is heated in an oil bath until the temperature of the reaction system reaches 75° C. Into the heated reaction vessel, the monomer-emulsion-dispersed liquid 1 is firstly added dropwise over two hours, and then the monomer emulsion dispersed liquid 2 is added dropwise over one hour to allow emulsion polymerization. Upon completion of dropwise addition, polymerization is further allowed to continue at a temperature of 75° C. and terminated after three hours. An obtained resin—particle-dispersed liquid is measured by a laser-diffraction-type particle size distribution measuring device (LA-700 manufactured by Horiba, Ltd.), and 290 nm is obtained as a number average primary particle size of the resin particles in the liquid. Similarly, measurement of glass transition point of the resin by means of a differential scanning calorimeter (DSC-50 manufactured by Shimadzu Corporation) with an temperature increase rate of 10° C./min. reveals a glass transition point of 52° C., and measurement of number average molecular weight (in polystyrene equivalent value) and weight average molecular weight by means of a gel permeation chromatography (GPC) molecular weight measurement device (HLC-8020 manufactured by Tosoh Corporation) with THF as solvent reveals a number average molecular weight of 12,000 (on a polystyrene basis) and a weight average molecular weight of 32,000. Subsequently, ion-exchange water is added to the dispersed liquid to adjust solid content in the dispersed liquid to 40%. Solid content is calculated from the weight of dry residues obtained by heating 3 grams of the dispersed liquid at a temperature of 130° C. for 30 minutes to vaporize moisture.

Preparation of Resin—Particle-Dispersed Liquid (L2):

Into a 5L flask that has been dried by heating, 1939 parts by mass of adipic acid, 1180 parts by mass of bisphenol A propylene oxide 2 mole additive, 118.4 parts by mass of dimethyl isophthalate-5-sodium sulfonate, and 0.7 parts by mass of dibutyltin oxide are introduced, and air is decompressed through pressure reducing operation in the flask. Further, after introducing a nitrogen gas into the flask to produce an inert atmosphere therein, the contents of the flask are refluxed at a temperature of 180° C. for 6 hours. Subsequent to reflux, the resulting mixture is gradually heated to 220° C. under reduced pressure, and then agitated for 4 hours. Molecular weight is examined by GPC when the mixture becomes viscous, and distillation under reduced pressure is terminated when the weight average molecular weight reaches 16,000. Then, the flask is air cooled to obtain a polyester resin. The obtained resin has an acid value of 8.9 mgKOH/g and a glass transition point (a peak value of the DSC) of 72° C. The product including the resin is referred to as a resin—particle-dispersed liquid (L2).

| <Method of Preparing Release-Agent- -Particle-Dispersed liquid> | |
|---|---|
| Preparation of Release-Agent- -Particle-Dispersed Liquid (W1): | 28 parts by mass |
| Polyalkylene wax ("FNP0085" manufactured by Nippon Seiro Co. Ltd,; melting point = 85° C.; viscosity at 140° C. = 4.8 mPas) | |
| Cationic surfactant ("NEOGEN RK" manufactured by Dai-ichikogyo Seiyaku Co., Ltd. including, as an active component, 4.6 weight percent of the cationic surfactant relative to the release agent) | 1.3 parts by mass |
| Ion-exchange water | 70.7 parts by mass |

The above components are dispersed while being heated by a homogenizer (ULTRA-TURRAX T50 manufactured by IKA Corporation) to a temperature of 95° C., and then further dispersed by means of a pressure-pump-type homogenizer (Gaulin Homogenizer manufactured by Gaulin) to produce a release-agent—particle-dispersed liquid. In the obtained release-agent—particle-dispersed liquid, the average particle size $D_{50}$ of release agent particles is 210 nm. Subsequently, ion exchange water is added to the release-agent—particle-dispersed liquid for adjusting solid content in the liquid to 25 weight percent.

EXAMPLE 1

| | |
|---|---|
| Polyaluminum chloride | 0.4 parts by mass |
| 0.1% nitrate water solution | 35.0 parts by mass |
| The above components are mixed by agitation to create a flocculant adjustment liquid. | |
| Next, a toner is prepared from the following components. | |
| Ion-exchange water | 700.0 parts by mass |
| Resin- -particle-dispersed liquid (L1) | 400.0 parts by mass |
| Release-agent- -particle-dispersed liquid (W1) | 100.0 parts by mass |
| Quinacridone-pigment-dispersed liquid 2 | 89.0 parts by mass |
| Naphthol-pigment-dispersed liquid 1 | 88.0 parts by mass |

The above components are sequentially placed in a 3L round-bottom flask made of stainless steel while being agitated to form a mixture. Then, while the mixture is further dispersed by means of the homogenizer (ULTRA-TURRAX T50 manufactured by IKA Corporation) at 4,500 rpm, a flocculent adjustment liquid having been prepared in advance is added to the mixture in such a manner that the entire volume of the liquid is poured during 2 minutes, and further dispersed for 5 minutes by means the homogenizer at 7,000 rpm to obtain a dispersed liquid. Then, after mounting an agitator with a magnetic seal and placing on the round-bottom flask a lid having a thermometer and a pH meter, a mantle heater for heating is set on the flask. While agitation is performed at a minimum rpm required for allowing the entire dispersed liquid to be agitated, the flask is heated to a temperature of 48° C. at a rate of 1° C./1 min. and maintained at the temperature of 48° C. for 30 minutes to obtain aggregate particles. Then, a particle size of the aggregate particles is examined by means of a coulter counter (TA-II manufactured by Nikkaki Bio Co., Ltd.). Subsequently, while the particle size of the aggregate particles is examined once every 15 minutes, the temperature inside the flask is raised at a rate of 1° C./15 min. Temperature rise is terminated when the volume average particle size of the aggregate particles reaches 4.9 μm, and the temperature at termination is maintained. Immediately after termination of the temperature rise, 240 parts by mass of the resin—particle-dispersed liquid (L1) is added into the flask. After the flask is allowed to stand for 30 minutes, a sodium hydroxide water solution of 5 percent concentration is added until the pH in the reaction system reaches 5.8. Then, temperature is raised by heating at a rate of 1° C./1 min. and the temperature rise is terminated upon attainment of a temperature of 96° C., which is maintained thereafter. The temperature is maintained for 3.0 hours to melt the aggregate particles by heat. Subsequently, the temperature of the system is lowered to 65° C., and pH in the system is adjusted to 9.0 by addition of the sodium hydroxide water solution. The reaction system is left standing for 30 minutes, then cooled, and extracted from the flask. An extracted product is sufficiently filtered and rinsed with ion-exchange water having a volume equal to 50 times that of the toner, and then dispersed again into ion-exchange water so as to form a solution including 10 weight percent solid content. This solution is adjusted to have a pH of 5.0 by the addition of nitric acid, then agitated for 30 minutes, and then sufficiently filtered and rinsed again with ion-exchange water until electrical conductivity of a filtrate reaches 10 μS/cm or below to obtain a slurry. The slurry is freeze-dried for 72 hours to produce a toner. Observation of a surface of the obtained toner with a scanning electron microscope (SEM) and a cross section thereof with a transmission electron microscope (TEM) reveals that the resin, pigment, and other admixtures has been melted as intended, and minute cavities and asperities are not found. In a dispersed state, the release agent mixedly assumes the forms of a rod and a lump having a maximum diameter or length of 900 nm, and particle size distribution and distribution of the forms are preferable. The toner for each color is adjusted by blending 1.5 parts by mass of hydrophobic silica (RY50 manufactured by NIPPON AEROSIL Co., Ltd.) and 1.0 part by mass of hydrophobic titanium oxide (T805 manufactured by NIPPON AEROSIL Co., Ltd.) into 100 parts of the toner by means of a sample mill at 10,000 rpm for 45 seconds. Physical properties of the resulting toner are listed in Table 1.

COMPARATIVE EXAMPLE 1

| | |
|---|---|
| Poly-aluminum chloride | 0.4 parts by mass |
| 0.1% Nitric acid water solution | 35.0 parts by mass |
| These components are mixed by agitation to prepare a flocculant adjustment liquid. | |
| Next, another toner is manufactured in a manner similar to that of the toner of Example 1, from the following components. | |
| Ion-exchange water | 700.0 parts by mass |
| Resin- -particle-dispersed liquid (L1) | 400.0 parts by mass |
| Release-agent- -particle-dispersed liquid (W1) | 100.0 parts by mass |
| Quinacridone-pigment-dispersed liquid 1 | 89.0 parts by mass |
| Naphthol-pigment-dispersed liquid 1 | 88.0 parts by mass |

Observation of a surface of the obtained toner with the scanning electron microscope (SEM) and a cross section thereof with the transmission electron microscope (TEM) reveals that the resin, pigment, and other admixtures has been melted intended, and minute cavities and asperities are not found. In a dispersed state, the release agent mixedly assumes the forms of a rod and a lump having a maximum diameter or length of 860 nm, and particle size distribution and distribution of the forms are preferable. The toner for each color is adjusted by blending 1.5 parts by mass of hydrophobic silica (RY50 manufactured by NIPPON AEROSIL Co., Ltd.) and 1.0 part by mass of hydrophobic titanium oxide (T805 manufactured by NIPPON AEROSIL Co., Ltd.) into 100 parts of the toner by means of the sample mill at 10,000 rpm for 45 seconds. Physical properties of the resulting toner are listed in Table 1.

EXAMPLE 2

| | |
|---|---|
| Poly-aluminum chloride | 0.4 parts by mass |
| 0.1% Nitric acid water solution | 35.0 parts by mass |
| These components are mixed by agitation to prepare a flocculant adjustment liquid. | |
| Next, another toner is manufactured in a manner similar to that of the toner of Example 1, from the following components. | |
| Ion-exchange water | 700.0 parts by mass |
| Resin- -particle-dispersed liquid (L1) | 400.0 parts by mass |
| Release-agent- -particle-dispersed liquid (W1) | 100.0 parts by mass |
| Quinacridone-pigment-dispersed liquid 1 | 89.0 parts by mass |
| Naphthol-pigment-dispersed liquid 2 | 88.0 parts by mass |

Observation of a surface of the obtained toner with the scanning electron microscope (SEM) and a cross section thereof with the transmission electron microscope (TEM) reveals that the resin, pigment, and other admixtures has been melted as intended, and minute cavities and asperities are not found. In a dispersed state, the release agent mixedly assumes the forms of a rod and a lump having a maximum diameter or length of 800 nm, and particle size distribution and distribution of the forms are preferable. The toner for each color is adjusted by blending 1.5 parts by mass of hydrophobic silica (RY50 manufactured by NIPPON AEROSIL Co., Ltd.) and 1.0 part by mass of hydrophobic titanium oxide (T805 manufactured by NIPPON AEROSIL Co., Ltd.) into 100 parts of the toner by means of the sample mill at 10,000 rpm for 45 seconds. Physical properties of the resulting toner are listed in Table 1.

EXAMPLE 3

| | |
|---|---|
| Poly-aluminum chloride | 0.4 parts by mass |
| 0.1% Nitric acid water solution | 35.0 parts by mass |
| These components are mixed by agitation to prepare a flocculant adjustment liquid. | |
| Next, another toner is manufactured in a manner similar to that of the toner of Example 1, from the following components. | |
| Ion-exchange water | 700.0 parts by mass |
| Resin- -particle-dispersed liquid (L2) | 400.0 parts by mass |
| Release-agent- -particle-dispersed liquid (W1) | 100.0 parts by mass |
| Quinacridone-pigment-dispersed liquid 3 | 89.0 parts by mass |
| Naphthol-pigment-dispersed liquid 2 | 88.0 parts by mass |

Observation of a surface of the obtained toner with the scanning electron microscope (SEM) and a cross section thereof with the transmission electron microscope (TEM) reveals that the resin, pigment, and other admixtures has been melted as intended, and minute cavities and asperities are not found. In a dispersed state, the release agent mixedly assumes the forms of a rod and a lump having a maximum diameter or length of 960 nm, and particle size distribution and distribution of the forms are preferable. The toner for each color is adjusted by blending 1.5 parts by mass of hydrophobic silica (RY50 manufactured by NIPPON AEROSIL Co., Ltd.) and 1.0 part by mass of hydrophobic titanium oxide (T805 manufactured by NIPPON AEROSIL Co., Ltd.) into 100 parts of the toner by means of the sample mill at 10,000 rpm for 45 seconds. Physical properties of the resulting toner are listed in Table 1.

COMPARATIVE EXAMPLE 2

| | |
|---|---|
| Poly-aluminum chloride | 0.4 parts by mass |
| 0.1% Nitric acid water solution | 35.0 parts by mass |
| These components are mixed by agitation to prepare a flocculant adjustment liquid. | |
| Next, another toner is manufactured in a manner similar to that of the toner of Example 1, from the following components. | |
| Ion-exchange water | 700.0 parts by mass |
| Resin- -particle-dispersed liquid (L1) | 400.0 parts by mass |
| Release-agent- -particle-dispersed liquid (W1) | 100.0 parts by mass |
| Quinacridone-pigment-dispersed liquid 1 | 89.0 parts by mass |
| Naphthol-pigment-dispersed liquid 3 | 88.0 parts by mass |

Observation of a surface of the obtained toner with the scanning electron microscope (SEM) and a cross section thereof with the transmission electron microscope (TEM) reveals that the resin, pigment, and other admixtures has been melted as intended, and minute cavities and asperities are not found. In a dispersed state, the release agent mixedly assumes the forms of a rod and a lump having a maximum length or diameter of 850 nm, and particle size distribution and distribution of the forms are preferable. The toner for each color is adjusted by blending 1.5 parts by mass of hydrophobic silica (RY50 manufactured by NIPPON AEROSIL Co., Ltd.) and 1.0 part by mass of hydrophobic titanium oxide (T805 manufactured by NIPPON AEROSIL Co., Ltd.) into 100 parts of the toner by means of the sample mill at 10,000 rpm for 45 seconds. Physical properties of the resulting toner are listed in Table 1.

TABLE 1

| | Type of Resin Particle | Mw of Resin | Mn of Resin | $D_{50}$ of Quinacridone Pigment (nm) | $D_{50}$ of Naphthol Pigment (nm) | Maximum Size of Release Agent |
|---|---|---|---|---|---|---|
| Example 1 | Acrylic Resin | 32,000 | 12,000 | 97 | 112 | 900 |
| Example 2 | Acrylic Resin | 32,000 | 12,000 | 118 | 195 | 800 |
| Example 3 | Polyester Resin | 16,000 | 7,000 | 32 | 195 | 960 |

TABLE 1-continued

| | Type of Resin Particle | Mw of Resin | Mn of Resin | $D_{50}$ of Quinacridone Pigment (nm) | $D_{50}$ of Naphthol Pigment (nm) | Maximum Size of Release Agent |
|---|---|---|---|---|---|---|
| Comparative Example 1 | Acrylic Resin | 32,000 | 12,000 | 118 | 112 | 860 |
| Comparative Example 2 | Acrylic Resin | 32,000 | 12,000 | 118 | 275 | 850 |

TABLE 2

| | Image preservability | Gloss of Image | Occurrence of Hot Offset | Optical Transparency of OHP |
|---|---|---|---|---|
| Example 1 | ◎ | ◎ | Not occur | ◎ |
| Example 2 | ◎ | ◎ | Not occur | ◎ |
| Example 3 | ◎ | ◎ | Not occur | ◎ |
| Comparative Example 1 | Δ | ◎ | Not occur | ◎ |
| Comparative Example 2 | Δ | Δ | Occur | Δ |

<Example of Manufacturing a Carrier>

| | |
|---|---|
| Mn—Mg series ferrite particles (density = 4.6 g/cm$^3$; average particle size = 35 μm; saturation magnetization = 65 emu/g) | 100 parts by mass |
| Toluene | 11 parts by mass |
| Copolymer of diethylaminoethylmethacrylate-styrene-methylmethacrylate (copolymerization ratio = 2:20:78; weight average molecular weight = 50,000) | 2 parts by mass |
| Carbon black ("R330R" manufactured by Cabot Corporation; average particle size = 25 nm; DBP value = 71 ml/100 g; resistivity = 10 Ωcm or less) | 0.2 parts by mass |

Glass beads (having a particle size of 1 mm and a volume equal to that of Toluene) and the above-described components other than the ferrite particles are introduced in a sand mill manufactured by Kansai Paint Co., Ltd. and agitated at a rate of 1,200 rpm for 30 minutes to prepare a solution for forming a coating resin layer. Then, the solution for forming a coating resin layer and the ferrite particles are introduced into a vacuum degassing kneader and agitated for 10 minutes while temperature is maintained at 60° C. After 10 minutes, the pressure in the kneader is reduced, and the toluene is evaporated, thereby forming the coating resin layer to obtain the carrier. The coating resin layer has a thickness of 1 μm. Resistivity of the carrier is $4\times10^{10}$ Ωcm under an electric field of $10^{3.8}$ V/cm. It should be noted that the value of the saturation magnetization is obtained by means of a sample-oscillating-type magnetometer (manufactured by Toei Industry Co., Ltd.) under an applied magnetic field of 3,000 (Oe).

<Preparation of Developer>

After 8 parts by mass of each of the toners obtained in the examples and the comparative examples is blended into 100 parts by mass of the above-described carrier by means of a V-type blender for 20 minutes, aggregates are removed from each of the resulting mixtures by an oscillating sieve having a mesh size of 212 microns to obtain a developer.

<Preparation of Makeup Toner>

After 10 parts by mass of each of the toners obtained in the examples and the comparative examples is blended into 2 parts by mass of the above-described carrier by means of the V-type blender for 20 minutes, aggregates are removed from each of the resulting mixtures by the oscillating sieve having a mesh size of 212 microns to obtain a makeup toner.

<Evaluation of Image Preservability>

Each of the obtained developers is provided to a developing device of DocuCentre Color 400 CP manufactured by Fuji Xerox Co., Ltd. and each of the obtained makeup toners is provided to a cartridge of the same. In provision of the developers and the makeup toners, the same developer and the same makeup toner are used for cyan, magenta, and yellow colors. After a volume of toner used for developing a monochromatic solid fill of each color on paper is adjusted to 4.0 mg/m$^2$, a solid fill having a volume equivalent to the tertiary color is output as a solid fill image having a size of 5 cm ×5 cm. Paper of trade name "C2r Paper" manufactured by Fuji Xerox Office Supply Co., Ltd. is used as printing paper. The printed solid fill image is covered with a white sheet of paper with no printed image placed on the printed solid fill image, and a load of 50 g/cm$^2$ is applied on the image from above the white sheet in an environmental chamber for a cyclic storage test. Taking one day as a cycle in which the environmental chamber is set to a temperature of 50° C. at 55% humidity for 12 hours and set to a temperature of 20° C. at 55% for another 12 hours, the cyclic storage test is continued for 7 days. Upon completion of the cyclic storage test, a state of image transition to the white sheet of paper having been stored for 7 days is evaluated. The state is rated against evaluation criteria in the following four categories: "superior," "good," "poor," and "bad" as represented by marks ◎, ○, Δ, and X in Table 2, respectively.

After the white sheet is peeled from the solid fill image:

◎—image transfer to the white sheet of paper does not occur;

○—image transfer occurs in a small portion (less than 20% the image area);

Δ—image transfer occurs in a portion equal to 20% to 50% the image area; and x—image transfer occurs in a portion larger than 50% the image area.

<Evaluation of Fixation>

Similar to the evaluation of image preservability, a monochromatic image of magenta color is output for measuring a degree of gloss of the fixed image. A gloss meter (Model GM-26D manufactured by MURAKAMI COLOR RESEARCH LABORATORY) is used for measurement of the degree of gloss while an angle of light incident upon a sample is set to 75 degrees. The degree of gloss is rated in four categories as follows. Values of 47 or greater are rated as superior, represented by mark ◎ in Table 2; values from 43 (inclusive) to 47 (exclusive) are rated as good, represented by mark ○; values from 40 (inclusive) to 43 (exclusive) are rated as poor, represented by mark Δ; and values smaller than 40 are rated as bad, represented by mark X.

Concurrently with the above output, the monochromatic image is also output in an OHP mode onto an OHP film (for monochrome printing, manufactured by Fuji Xerox Co., Ltd.) for measuring optical transparency (of a HAZE value). The optical transparency is measured by means of a HAZE Meter TC-HIII type DP (manufactured by Tokyo Denshoku Co., Ltd)) and rated in four categories as follows. Values of 70 or greater are rated as superior, represented by mark ◎ in Table 2; values from 67 (inclusive) to 70 (exclusive) are rated as good, represented by mark ○; values from 64 (inclusive) to 67 (exclusive) are rated as poor, represented by mark Δ; and values smaller than 64 are rated as bad, represented by mark X.

In addition, after the volume of toner used for monochromatic developing is changed from 4.0 mg/m$^2$ to 4.5 mg/m$^2$, an evaluation is made as to whether or not a hot offset and winding of paper to a fixation device occurs. (A greater volume of toner used for developing thickens an image, which increases the occurrence of the hot offset and the winding of paper to a fusing device.) In this evaluation, paper of trade name "C2r Paper" manufactured by Fuji Xerox Office Supply Co., Ltd. is used. An image equivalent of the tertiary color is printed on A4 paper in landscape orientation with a 5 mm margin from the edge of the A4 paper, and the size of the image is 20 mm×the entire width of the A4 paper. When neither the offset nor the winding to the fusing device occurs, a rating of success, represented by mark ◎, is awarded, and when either or both occur, a rating of failure, represented by mark X, is awarded.

<Evaluation of Running>

Further, a running test is conducted while the developers and the makeup toners are loaded in a manner similar to that for the evaluation of image preservability, and the volume of toner for developing a solid fill image in monochrome on paper is adjusted to 4.0 mg/m$^2$. In the running test, a comprehensive business chart including a solid fill, a halftone, text, a graph, a drawing, and other representation is used. A size of the chart to be printed during the running test is adjusted in such a manner that 20 mg of toner of one color is consumed per sheet of A4 paper. In the evaluation, an amount of electric charge (−μC/g) is measured once every 5,000 operations of image output, by a blow-off measurement method in conjunction with evaluation of image quality. Image quality is evaluated by use of a comprehensive chart including a portrait, a landscape, text, and other representation in addition to a chart rendered in the primary colors magenta, cyan, and yellow, secondary colors of red, blue, and green, each created by overlaying two of the primary colors in a ratio of 1:1, and gray-scale gradations of the primary and secondary colors. Evaluation criteria consisting of graininess, gradation/pseudo edge, uniformity in print density, occurrence of edge effect, and occurrence of other image quality results are rated by visual inspection. A condition that the amount of electric charge is maintained at a level greater than or equal to 85% of that in the initial stage of the running test is used as a basis for continuing the running test, whereas the running test is ceased at the time of occurrence of an error in the image quality, the amount of electric charge, or the like. Further, the running test is performed using paper of trade name "C2r Paper" manufactured by Fuji Xerox Office Supply Co., Ltd. under high temperature and high humidity conditions of 30° C. at 80 RH % humidity, which is a hostile environment for a developer and a copier.

<Evaluation Result>

When 100,000 or more sheets are output without error in the running test, it is determined that no problem arises in practical use. The toners in examples 1, 2, and 3 according to the present invention can clear their mandated levels and produce images of good quality upon completion of 100,000-sheet printing, without developing a problem associated with properties other than image quality, such as transfer property and coloring property.

Other examples 4 to 12 and comparative examples 3 to 5 prepared by another method will be described below.

EXAMPLE 4

| | |
|---|---|
| Poly-aluminum chloride | 0.4 parts by mass |
| 0.1% Nitric acid water solution | 35.0 parts by mass |
| The above constituents are mixed by agitation to prepare a flocculant adjustment liquid. | |
| Next, a toner is manufactured from the following components. | |
| Ion-exchange water | 700.0 parts by mass |
| Resin- -particle-dispersed liquid (L1) | 400.0 parts by mass |
| Release-agent- -particle-dispersed liquid (W1) | 100.0 parts by mass |
| Quinacridone-pigment-dispersed liquid 1 | 89.0 parts by mass |
| Naphthol-pigment-dispersed liquid 2 | 88.0 parts by mass |

The above components are sufficiently mixed in an agitation tank with a clothing-jacket to form a mixture, and then the mixture is introduced, from a foot valve of the agitation tank, into a disperser, such as CAVITRON CD1010 manufactured by Pacific Machinery & Engineering Co., Ltd. while the flocculant adjustment liquid is gradually fed to the mixture. Loop piping comprising a clothing jacket is installed to the agitation tank to create a flow path which allows the mixture to return to the agitation tank from above, and cooling water is fed into the clothing-jacket of the loop piping. The mixture is dispersed while circulating through the flow path. At this time, dispersion is performed by means of an outermost rotor having a total cross-sectional area of slits A of 134.4 mm$^2$ (=slit width×slit height×the number of slits) and an outermost stator having a slit number multiple K of 8,640 (=number of slits of the outermost rotor of 96×number of slits of the outermost stator of 90) for 5 minutes at a rate of 11,200 rpm achieving a circumferential velocity v of 40.4 m/s. A circulation flow rate Q of dispersed liquid varies depending on the numbers of slits of the rotor and the stator and the total cross-sectional area of slits, and is affected by the inner rotor and stator when a plurality of the rotors and stators are equipped. In this example, the circulation flow rate Q is 1.64 m$^3$/h, and $F=1.92\times10^7$. In measurement by means of Multisizer II, a volume average primary particle size of 2.378 μm, upper GSDv of 1.299, and >16 μm of 0% are obtained.

Toner particles are manufactured from the above-described dispersed liquid. The dispersed liquid is heated in an agitation tank equipped with a heating jacket to a temperature of 52° C. and maintained at the temperature for 90 minutes. At this stage, aggregated particles having a volume average primary particle size $D_{50v}$ of approximately 4.9 μm are found in the dispersed liquid.

Then, 4.3 parts by mass of the resin—particle-dispersed liquid 1 are slowly added to the dispersed liquid, which is allowed to stand for 1 hour. After lapse of 1 hour, aggregated particles having a volume average primary particle size $D_{50v}$ of approximately 5.3 μm are found in the dispersed liquid.

Next, 1.5 parts by mass of 4% sodium hydrate water solution is added to the obtained dispersed liquid, which is subsequently heated to a temperature of 95° C. and then maintained at the temperature for 5 hours to melt the aggregated particles. Subsequently, the dispersed liquid is cooled, then filtered through a nylon mesh having a 20 μm mesh size, and further filtered through a filter cloth having a 3 μm mesh size. Subsequent to filtering, resultant cake is sufficiently rinsed with ion-exchange water, and dried in a vacuum dryer to obtain toner A.

Particle-size and grain-size distribution indices of the present invention are obtained on the basis of Grain-size distribution measured by means of a measuring instrument of Couler Multisizer II (manufactured by Beckmann Coulter Inc.) by plotting cumulative distributions of volume and number of particles from a smaller size relative to a divided particle size range, respectively, and defining the volume average primary particle size and the number average particle size which yield 16% accumulation as $D_{16v}$ and $D_{16p}$, those which yield 50% accumulation as $D_{50v}$ and $D_{50p}$, and those which yield 84% accumulation as $D_{84v}$ and $D_{84p}$. A volume average particle size distribution index GSDv, number average particle size distribution index GSDp, and index GSDvup are calculated by the following equations: $GSDv=(D_{84v}/D_{16v})^{0.5}$, $GSDp=(D_{84p}/D_{16}p)^{0.5}$, and $GSDvup=(D_{84v}/D_{50v})$. In addition, accumulation of particles having a volume average primary particle size of 16 μm or greater is represented by >16 μm.

EXAMPLE 5

Similar to Example 4, the same components are dispersed in the same manner. Dispersion is performed by means of an outermost rotor having a total cross-sectional area of slits A of 134.4 $mm^2$ and an outermost stator having a slit number multiple K of 8,640, for 5 minutes at a rate of 13,070 rpm, achieving a circumferential velocity v of 47.2 m/s. In this example, the circulation flow rate Q of dispersed liquid is 1.60 $m^3/h$, and $F=2.69\times10^7$. In addition, measurement by means of Multisizer II revealed a volume average primary particle size of 2.340 μm, GSDv of 1.330, and >16 μm of 1.250%. From this dispersed liquid, toner particles are prepared in a manner similar to that of Example 4, to obtain toner B.

EXAMPLE 6

Similar to Example 4, the same constituents are dispersed in the same manner. At this time, dispersion is performed by means of an outermost rotor having a total cross-sectional area of slits A of 134.4 $mm^2$ and an outermost stator having a slit number multiple K of 8,640, for 5 minutes at a rate of 10,000 rpm, achieving a circumferential velocity v of 36.1 m/s. In this example, the circulation flow rate Q of dispersed liquid is 1.50 $m^3/h$, and $F=1.68\times10^7$. In addition, measurement by means of Multisizer II reveals a volume average primary particle size of 2.351 μm, GSDv of 1.289, and >16 μm of 0.102%. From this dispersed liquid, toner particles are prepared in a manner similar to that of Example 4, to obtain toner C.

EXAMPLE 7

Similar to Example 4, the same constituents are dispersed in the same manner. At this time, dispersion as performed by means of an outermost rotor having a total cross-sectional area of slits A of 349.6 $mm^2$ and an outermost stator having a slit number multiple K of 7912, for 5 minutes at a rate of 8,650 rpm, achieving a circumferential velocity v of 31.2 m/s. In this example, the circulation flow rate Q of dispersed liquid is 1.82 $m^3/h$, and $F=2.46\times10^7$. In addition, measurement by means of Multisize II reveals a volume average primary particle size of 2.359 μm, GSDv of 1.181, and >16 μm of 0%. From this dispersed liquid, toner particles are prepared in a manner similar to that of Example 4, to obtain toner D.

EXAMPLE 8

Similar to Example 4, the same constituents are dispersed in the same manner. At this time, dispersion is performed by means of an outermost rotor having a total cross-sectional area of slits A of 349.6 $mm^2$ and an outermost stator having a slit number multiple K of 7,912, for 5 minutes at a rate of 11,200 rpm, achieving a circumferential velocity v of 40.4 m/s. In this example, the circulation flow rate Q of dispersed liquid is 2.00 $m^3/h$, and $F=3.75\times10^7$. In addition, measurement by means of Multisizer II reveals a volume average primary particle size of 2.429 μm, GSDv of 1.284, and >16 μm of 0%. From this dispersed liquid, toner particles are prepared in a manner similar to that of Example 4, to obtain toner E.

EXAMPLE 9

Similar to Example 4, the same constituents are dispersed in the same manner. At this time, dispersion is performed by means of an outermost rotor having a total cross-sectional area of slits A of 349.6 $mm^2$ and an outermost stator having a slit number multiple K of 7,912, for 5 minutes at a rate of 13,070 rpm, achieving a circumferential velocity v of 47.2 m/s. In this example, the circulation flow rate Q of dispersed liquid is 2.20 $m^3/h$, and $F=4.65\times10^7$. In addition, measurement by means of Multisizer II reveals a volume average primary particle size of 2.423 μm, GSDv of 1.254, and >16 μm of 0%. From this dispersed liquid, toner particles are prepared in a manner similar to that of Example 4, to obtain toner F.

EXAMPLE 10

Similar to Example 4, the same constituents are dispersed in the same manner. At this time, dispersion is performed by means of an outermost rotor having a total cross-sectional area of slits A of 120.4 $mm^2$ and an outermost stator having a slit number multiple K of 6,880, for 5 minutes at a rate of 13,070 rpm, achieving a circumferential velocity v of 47.2 m/s. In this example, the circulation flow rate Q of dispersed liquid is 1.31 $m^3/h$, and $F=2.36\times10^7$. In addition, measurement by means of Multisizer II reveals a volume average primary particle size of 2.348 μm, GSDv of 1.288, and >16 μm of 0%. From this dispersed liquid, toner particles are prepared in a manner similar to that of Example 4, to obtain toner G.

EXAMPLE 11

Similar to Example 4, the same constituents are dispersed in the same manner. At this time, dispersion is performed by means of an outermost rotor having a total cross-sectional area of slits A of 120.4 $mm^2$ and an outermost stator having a slit number multiple K of 6,880, for 5 minutes at a rate of 11,200 rpm, achieving a circumferential velocity v of 40.4 m/s. In this example, the circulation flow rate Q of dispersed liquid is 1.24 $m^3$/h, and F =1.80×$10^7$. In addition, measurement by means of Multisizer II reveals a volume average primary particle size of 2.402 μm, GSDv of 1.254, and >16 μm of 0.119%. From this dispersed liquid, toner particles are prepared in a manner similar to that of Example 4, to obtain toner H.

EXAMPLE 12

Similar to Example 4, the same constituents are dispersed in the same manner. At this time, dispersion is performed by means of an outermost rotor having a total cross-sectional area of slits A of 120.4 $mm^2$ and an outermost stator having a slit number multiple K of 6,880, for 5 minutes at a rate of 10,000 rpm, achieving a circumferential velocity v of 40.4 m/s. In this example, the circulation flow rate Q of dispersed liquid is 1.21 $m^3$/h, and F =1.50×$10^7$. In addition, measurement by means of Multisize II reveals a volume average primary particle size of 2.487 μm, GSDv of 1.257, and >16 μm of 0%. From this dispersed liquid, toner particles are prepared in a manner similar to that of Example 4, to obtain toner I.

COMPARATIVE EXAMPLE 3

Similar to Example 4, the same constituents are dispersed in the same manner. At this time, dispersion is performed by means of an outermost rotor having a total cross-sectional area of slits A of 134.4 $mm^2$ and an outermost stator having a slit number multiple K of 8,640, for 5 minutes at a rate of 11,200 rpm, achieving a circumferential velocity v of 40.4 m/s. In this example, the circulation flow rate Q of dispersed liquid is 2.00 $m^3$/h, and F =1.55×$10^7$. In addition, measurement by means of Multisizer II reveals a volume average primary particle size of 2.429 μm, GSDv of 1.284, and >16 μm of 1.344%. From this dispersed liquid, toner particles are prepared in a manner similar to that of Example 4, to obtain toner J.

COMPARATIVE EXAMPLE 4

Similar to Example 4, the same constituents are dispersed in the same manner. At this time, dispersion is performed by means of an outermost rotor having a total cross-sectional area of slits A of 134.4 $mm^2$ and an outermost stator having a slit number multiple K of 8,640, for 10 minutes at a rate of 11,200 rpm, achieving a circumferential velocity v of 40.4 m/s. In this example, the circulation flow rate Q of dispersed liquid is 2.00 $m^3$/h, and F =1.55×$10^7$. In addition, measurement by means of Multisize II reveals a volume average primary particle size of 2.379 μm, GSDv of 1.820, and >16 μm of 5.199%. Prolonged dispersing time has no effect on further pulverization of coarse particles. From this dispersed liquid, toner particles are prepared in a manner similar to that of Example 4, to obtain toner K.

COMPARATIVE EXAMPLE 5

Similar to Example 4, the same constituents are dispersed in the same manner. At this time, dispersion is performed by means of an outermost rotor having a total cross-sectional area of slits A of 134.4 $mm^2$ and an outermost stator having a slit number multiple K of 8,640, for 5 minutes at a rate of 11,200 rpm, achieving a circumferential velocity v of 40.4 m/s. In this example, the circulation flow rate Q of dispersed liquid is 1.64 $m^3$/h, and F =1.92×$10^7$. In addition, measurement by Multisizer II reveals a volume average primary particle size of 2.718 μm, GSDv of 1.214, and >16 μm of 0%. From this dispersed liquid, toner particles are prepared in a manner similar to that of Example 4, to obtain toner L.

Preparation data in Examples 4 to 12 and Comparative Examples 3 to 5 are listed below in Tables 3 and 4.

TABLE 3

| | Dispersion Time [min] | Dispersion Temperature [° C.] | v [m/s] | n [rpm] | K [—] | A [$m^2$] | Q [$m^3$/h] | F × $10^{-7}$ [—] | $D_{50v}$ [μm] | GSDv up[—] | >16 μm [%] |
|---|---|---|---|---|---|---|---|---|---|---|---|
| Example 4 | 5 | 24.9 | 40.4 | 11200 | 8640 | 134.4 | 1.64 | 1.92 | 2.378 | 1.299 | 0 |
| Example 5 | 5 | 27.5 | 47.2 | 13070 | 8640 | 134.4 | 1.60 | 2.69 | 2.340 | 1.330 | 1.250 |
| Example 6 | 5 | 21.7 | 36.1 | 10000 | 8640 | 134.4 | 1.50 | 1.68 | 2.351 | 1.289 | 0.102 |
| Example 7 | 5 | 21.3 | 31.2 | 8650 | 7912 | 349.6 | 1.82 | 2.46 | 2.359 | 1.181 | 0 |
| Example 8 | 5 | 30.6 | 40.4 | 11200 | 7912 | 349.6 | 2.00 | 3.75 | 2.429 | 1.284 | 0 |
| Example 9 | 5 | 26.8 | 47.2 | 13070 | 7912 | 349.6 | 2.20 | 4.65 | 2.423 | 1.254 | 0 |
| Example 10 | 5 | 26.5 | 47.2 | 13070 | 6880 | 120.4 | 1.31 | 2.36 | 2.348 | 1.288 | 0 |
| Example 11 | 5 | 24.5 | 40.4 | 11200 | 6880 | 120.4 | 1.24 | 1.80 | 2.402 | 1.254 | 0.119 |
| Example 12 | 5 | 23.5 | 36.1 | 10000 | 6880 | 120.4 | 1.21 | 1.50 | 2.487 | 1.257 | 0 |
| Comp. Example 3 | 5 | 23.4 | 40.4 | 11200 | 8640 | 134.4 | 2.04 | 1.55 | 2.365 | 1.711 | 1.344 |
| Comp. Example 4 | 10 | 25 | 40.4 | 11200 | 8640 | 134.4 | 2.04 | 1.55 | 2.379 | 1.820 | 5.199 |
| Comp. Example 5 | 5 | 35.2 | 40.4 | 11200 | 8640 | 134.4 | 1.64 | 1.92 | 2.718 | 1.214 | 0 |

TABLE 4

| | $D_{50}$v [μm] | GSDv up [—] | >16 μm [%] | Image Quality |
|---|---|---|---|---|
| Example 4/Toner (A) | 5.43 | 1.185 | 0.46 | ○ |
| Example 5/Toner (B) | 5.60 | 1.192 | 0.05 | ◎ |
| Example 6/Toner (C) | 5.54 | 1.195 | 0.10 | ○ |
| Example 7/Toner (D) | 5.50 | 1.195 | 0.11 | ◎ |
| Example 8/Toner (E) | 5.52 | 1.193 | 0.45 | ○ |
| Example 9/Toner (F) | 5.62 | 1.192 | 0.35 | ○ |
| Example 10/Toner (G) | 5.58 | 1.189 | 0.42 | ○ |
| Example 11/Toner (H) | 5.48 | 1.188 | 0.20 | ○ |
| Example 12/Toner (I) | 5.67 | 1.184 | 0.10 | ◎ |
| Comp. Example 3/Toner (J) | 5.53 | 1.257 | 4.34 | x |

TABLE 4-continued

| | $D_{50}v$ [μm] | GSDv up [—] | >16 μm [%] | Image Quality |
|---|---|---|---|---|
| Comp. Example 4/Toner (K) | 5.48 | 1.260 | 4.51 | x |
| Comp. Example 5/Toner (L) | 5.59 | 1.249 | 4.28 | x |

Next, Example 13 and Comparative Example 5, in which a pigment-dispersed liquid is prepared by means of the circulation line depicted in FIG. 1, will be described.

EXAMPLE 13

Each of the quinacridone-pigment-dispersed liquid 2 and the naphthol-pigment-dispersed liquid 1 used in Example 1 is individually introduced into a mixing tank shown in FIG. 1, and sufficiently agitated for pigment wetting. Each of the agitated quinacridone- and naphthol-pigment-dispersed liquids 2 and 1 is circulated for 20 minutes by means of a primary dispersing device ("CAVITRON CD1010" manufactured by Pacific Machinery & Engineering Co., Ltd.) through a cyclic line starting from the bottom of the mixing tank and returning, via the primary dispersing device, to the same mixing tank. Upon completion of the dispersion, an average particle size of pigments is 0.54 micron. Each of the preliminarily dispersed liquids is transported to a dispersing tank by the same CAVITRON CD1010, and then circulated by a secondary dispersing device ("ULTIMIZER HJP25008" manufactured by SUGINO MACHINE LIMITED) for 110 minutes in another cyclic line starting from the dispersing tank and returning, via the ULTIMIZER HJP25008, to the same dispersing tank, to obtain a quinacridone-pigment-dispersed liquid 4 or a naphthol-pigment-dispersed-liquid 4, respectively. For dispersion, the ULTIMIZER is operated to output a dispersion pressure of 240 MPa. After the dispersion, the average particle size of pigments is 230 nm, and no particle having a size greater than 0.5 micron is found in the quinacridone- or naphthol-pigment-dispersed liquids 4.

From the above quinacridone- and naphthol-pigment-dispersed liquids 4, a toner is manufactured in a manner similar to that of Example 1, and a cross section of toner particle is observed under an electron microscope. A particle size of colorant (magenta pigments) in the toner falls within the average pigment particle size in both of the pigment-dispersed liquids 4, and the pigments are uniformly distributed in the toner particle. From the obtained toner, a developer is further formed. While the developer is used as a electrostatic latent image developer, a fixed image is formed on an OHP film in an image forming apparatus (a modified version of "A color" manufactured by Fuji Xerox Co., Ltd.). Measurement of PE value of the fixed image reveals that 75% of sufficient transparency is yielded, and the electrostatic latent image developer containing the above-described toner has good optical transparency and coloring property.

COMPARATIVE EXAMPLE 6

Each of the quinacridone-pigment-dispersed liquid 2 and the naphthol-pigment-dispersed liquid 1 used in Example 1 is individually introduced into the mixing tank and sufficiently agitated for pigment wetting. Each of the agitated quinacridone—and naphthol-pigment-dispersed liquids 2 and 1 is circulated for 20 minutes by the primary dispersing device ("CAVITRON CD1010" manufactured by Pacific Machinery & Engineering Co., Ltd.) through a cyclic line starting from the bottom of the mixing tank shown in FIG. 1 and returning, via the primary dispersing device, to the same mixing tank. Upon completion of the dispersion, the average particle size of the colorant is 0.54 micron. Each of the preliminarily dispersed liquids is transported to the dispersing tank by means of a diaphragm pump, and then circulated under conditions similar to those of Example 13 for 270 minutes, to obtain a quinacridone-pigment-dispersed liquid 5 or a naphthol-pigment-dispersed liquid 5, respectively. For dispersion, the ULTIMIZER is operated to output a dispersion pressure of 200 MPa. After the dispersion, the average particle size is 0.25 microns, and almost no particles having a size greater than 0.5 micron are found in the quinacridone- and naphthol-pigment-dispersed liquids 5. On the other hand, when circulation is performed for 110 minutes, equal to that performed on the quinacridone- and naphthol-pigment-dispersed liquids 4, the average particle size is 0.30 microns, and almost 2% of the particles have a size of 0.5 microns or greater. Further, in an early stage of the second dispersion operation, the dispersed liquid is not circulated at a steady flow rate, causing variation in the dispersion pressure, with a result of applying a mechanical load to the apparatus. In addition, the finally-collected colorant-dispersed liquid contains a small number of coarse particles.

In addition, when toner particles are manufactured in a manner similar to Example 1 except for use of the quinacridone-pigment-dispersed liquid 5 and the naphthol-pigment-dispersed liquid 5, toner particles having a size of 5.8 μm, GSDv of 1.19, and GSDp of 1.22 are obtained. In a toner granulating step, a portion of the colorant is liberated rather than being included in aggregated particles, thereby lowering concentration of colorants in the toner particle, causing a problematic degradation in the coloring property of the toner. A fixed image is also formed on an OHP film to evaluate the created fixed image. In evaluation, PE value is 65%, indicating that optical transparency is reduced.

Next, effects of removing coarse particles from a toner slurry by means of apparatuses shown in FIGS. 6 to 9 will be described in Examples 14 to 17 and Comparative Examples 7 to 11.

EXAMPLE 14

The toner slurry obtained in Example 1 is cooled to a temperature of 35° C. to obtain a toner slurry having a solid content of 15 wt %. For the obtained toner slurry, measurement of volume average primary particle size ($D_{50v}$) of melted particles by means of an aperture having a diameter of 100 μm of Coulter Multisizer II (manufactured by Beckmann Coulter Inc.) yields a value of 5.8 μm. In addition, measurement of a shape factor SF1 by means of an image analyzer yields a value of 127. Accordingly, 84% volume-based particle size (D84v) is 7.1 μm, coarse particles having a size of 20 μm or greater represent 1.1 vol % of the general amount of melted particles, and those having a size of 15 μm or greater represent 1.5 vol % of the total amount of coalesced particles.

The toner slurry is screened through a circular oscillating sieve having a mesh frame diameter of ϕ 300 (with an effective mesh area of 0.07 $m^2$).

The sieve comprises a nylon mesh having a mesh size W of 15 μm and a wire diameter d of 35 μm, and another nylon mesh having a mesh size of 600 μm installed below. A tension of the mesh is measured by means of SEFAR-NEWTON-TESTER.

At a mesh tension set to 9 N/cm, the circular oscillating sieve is modulated to oscillate at an oscillation frequency of 35 $s^{-1}$ with amplitude a of 5 mm in a vertical direction and amplitude b of 3 mm in a horizontal direction relative to a mesh in the sieve frame (p). The toner slurry is continuously provided to the sieve at a feed rate of 150 kg/h. After 15 hours from the initiation of provision of the toner slurry, overflow of the toner slurry from the top of the mesh occurs, whereby the provision is terminated.

It should be noted that a situation in which the total amount of slurry drained from a coarse particle discharge port provided above the mesh reaches 5 kg is defined as "overflow."

A rate of collecting the slurry until the overflow occurs is 99.5 wt %. In a measurement of the screened slurry by means of a coulter counter, the amount of particles having a size of 20 μm or greater is found to be 0.0 vol %. After the mesh having been used for screening is cleaned with water, an average rate of clogged mesh on three locations (identified by visual inspection) is calculated through image analysis, yielding a rate of 25%.

EXAMPLE 15

The screening of the toner slurry is performed in a manner similar to that of Example 14, except that the mesh tension is set to 13 N/cm. After 7 hours from the initiation of provision of the toner slurry, overflow of the toner slurry from the top of the mesh occurs, whereby the provision is terminated. The rate of collecting the slurry until the occurrence of overflow is 98.9 wt %. In measurement of the screened slurry using the coulter counter, the amount of particles having a size of 20 μm or greater is found to be 0.0 vol %. In addition, the calculated rate of clogged mesh is 32%.

EXAMPLE 16

Screening of the toner slurry is performed in a manner similar to that of Example 14, except that the oscillation frequency is modulated to 70 $s^{-1}$. After 4 hours from the initiation of provision of the toner slurry, overflow of the toner slurry from the top of the mesh occurs, whereby the provision is terminated. The rate of collecting the slurry until the occurrence of overflow is 98.5 wt %. In measurement of the screened slurry by means of the coulter counter, the amount of particles having a size of 20 μm or greater is found to be 0.1 vol %. In addition, the calculated rate of clogged mesh is 40%.

COMPARATIVE EXAMPLE 7

Screening of the toner slurry is performed in a manner similar to that of Example 14, except that the mesh tension is set to 2 N/cm. After 5 minutes from the initiation of provision of the toner slurry, overflow of the toner slurry from the top of the mesh occurs, whereby the provision is terminated. Then, formation of a toner cake layer is found on the mesh. The amount of particles having a size of 20 μm or greater is 0.8 vol %, the rate of collecting the slurry is 55%, and the rate of clogged mesh is 83%.

COMPARATIVE EXAMPLE 8

Screening of the toner slurry is performed in a manner similar to that of Example 14, except that the mesh tension is set to 22 N/cm. After 10 minutes from the initiation of provision of the toner slurry, bubbles start to spill over from a slurry feed port, and after one hour further, overflow of the toner slurry from the top of the mesh occurs, whereby the provision is terminated. Then, the amount of particles having a size of 20 μm or greater is 0.6 vol %, the rate of collecting the slurry is 95%, and the rate of clogged mesh is 63%.

EXAMPLE 17

After the oscillation frequency is modulated to 35 $s^{-1}$ and the amplitude a in the vertical direction relative to the mesh in the mesh frame (p) is adjusted to 1 mm and the amplitude b in the horizontal direction relative to the mesh in the mesh frame (p) is set to 1.5 mm, the toner slurry is provided at a feed rate of 150 kg/h. After 1.5 hours from the initiation of provision of the toner slurry, overflow of the slurry from the top of the mesh occurs, whereby the provision is terminated.

The rate of collecting the slurry until the occurrence of overflow is 96.5 wt %. In measurement of the screened slurry by means of a coulter counter, the amount of particles having a size of 20 μm or greater is found to be 0.0 vol %, and calculation result of the average rate of clogged mesh is 47%.

COMPARATIVE EXAMPLE 9

Screening of the toner slurry is performed in a manner similar to that of Example 16, except that the amplitude a is set to 8 mm and the amplitude b is set to 7 mm. After 45 minutes from the initiation of provision of the toner slurry, overflow of the toner slurry from the top of the mesh occurs, whereby the provision is terminated. Then, the rate of collecting the slurry until the occurrence of overflow occurs is 93.0 wt %. In addition, the amount of particles having a size of 20 μm or greater is 0.3 vol %, and the rate of clogged mesh is 70%.

COMPARATIVE EXAMPLE 10

Screening of the toner slurry is performed in a manner similar to that of Example 16, except that the oscillation frequency is modulated to 90 $s^{-1}$. After 5 hours from the initiation of screening, an amount of coarse particles in the screened slurry starts to increase, whereby operation is terminated. In examination of the sieve mesh, a break is found at a junction between the sieve frame and the mesh. Because unscreened slurry is also contained in the screened slurry on a collecting side, the rate of collecting and other values are not measured.

COMPARATIVE EXAMPLE 11

Screening of the toner slurry is performed in a manner similar to that of Example 16, except that the amplitude a is set to 1 mm and the amplitude b is set to 0.5 mm. After 7 minutes from the initiation of screening, overflow of the toner slurry from the top of the mesh occurs, whereby provision of the slurry is terminated. Then, the rate of collecting the slurry until the occurrence of overflow is 55 wt %. In measurement of the screened slurry by means of the coulter counter, the amount of particles having a size of 20 μm or greater is found to be 0.6 vol %. In addition, the rate of clogged mesh is found to be 65%.

TABLE 5

| | Example 14 | Example 15 | Example 16 | Example 17 |
|---|---|---|---|---|
| Mesh Size (μm) | 15 | 15 | 15 | 15 |
| Mesh Tension (N/cm) | 9 | 13 | 9 | 11 |
| Frequency: H ($s^{-1}$) | 35 | 35 | 70 | 35 |
| Amplitude: sqrt($a^2 + b^2$) (mm) | 5.8 | 5.8 | 5.8 | 1.8 |
| Time Until Slurry Overflow | 15 hours | 7 hours | 4 hours | 1.5 hours |

TABLE 5-continued

| | Example 14 | Example 15 | Example 16 | Example 17 |
|---|---|---|---|---|
| Rate of Collecting Screened Slurry (wt %) | 99.5 | 98.9 | 98.5 | 96.5 |
| Amount of Particles Having a Size of 20 μm or Greater in Screened Slurry (vol %) | 0.0 | 0.0 | 0.1 | 0.0 |
| Rate of Clogged Mesh (%) | 25 | 32 | 40 | 47 |

TABLE 6

| | Comp. Example 7 | Comp. Example 8 | Comp. Example 9 | Comp. Example 10 | Comp. Example 11 |
|---|---|---|---|---|---|
| Mesh Size (μm) | 15 | 15 | 15 | 15 | 15 |
| Mesh Tension (N/cm) | 2 | 22 | 11 | 11 | 11 |
| Frequency: H ($s^{-1}$) | 35 | 35 | 35 | 90 | 35 |
| Amplitude: sqrt($a^2 + b^2$) (mm) | 5.8 | 5.8 | 10.6 | 1.8 | 1.2 |
| Time Until Slurry Overflow | 5 min. | 1 hour | 45 min. | Unable to Measure | 7 min. |
| Rate of Collecting Screened Slurry (wt %) | 55 | 95 | 93 | Unable to Measure | 55 |
| Amount of Particles Having a Size of 20 μm or Greater in Screened Slurry (vol %) | 0.8 | 0.6 | 0.3 | Unable to Measure | 0.6 |
| Rate of Clogged Mesh (%) | 83 | 65 | 70 | Unable to Measure | 65 |

As is evident from the above results, by adjusting the tension of a mesh used in the oscillating sieve and the frequency and amplitude of the sieve, clogging of mesh and formation of the caked-on layer can be suppressed while coarse particles of relatively small size are removed, thereby facilitating stable screening over a prolonged period. It is eventually found to be possible to manufacture a toner in which coarse particles having a detrimental effect on image quality are reduced in number.

The method of manufacturing an electrostatic latent image developing magenta toner, electrostatic latent image developer, and a toner and image forming method according to the present invention can advantageously be used in image printing, especially color printing through electrophotography and electrostatic recording.

The entire description of Japanese Patent Application No. 2004-249040 filed on Aug. 27, 2004 including the specification, claims, drawings, and abstract, is incorporated herein by reference.

What is claimed is:

1. An electrostatic latent image developing magenta toner including a quinacridone pigment, a naphthol pigment, and a release agent, wherein colorant of the toner satisfies conditions (a) and (b) below:

(a) an average primary particle size D50 of a quinacridone pigment represented by formula (1) and an average primary particle size D50 of a naphthol pigment represented by formula (2) are such that the average primary particle size D50 of the quinacridone pigment is smaller than the average primary particle size D50 of the naphthol pigment; and (b) the average primary particle size D50 of the quinacridone pigment is greater than 20 nm, and the average primary particle size D50 of the naphthol pigment is smaller than 200 nm;

formula (1) being

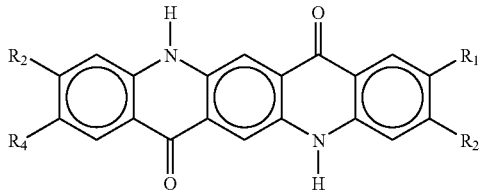

in which each of $R_1$, $R_2$, $R_3$, and $R_4$ is selected from the group consisting of H, $CH_3$, and Cl; $R_1$ and $R_2$ are different from each other; and $R_3$ and $R_4$ are different from each other; and formula (2) being

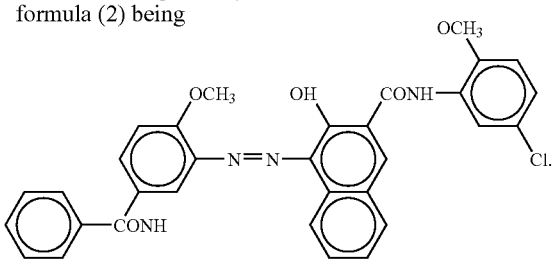

2. An electrostatic latent image developing magenta toner as defined in claim 1, wherein the quinacridone pigment includes any one of pigment red 122, pigment red 202, and pigment red 209.

3. An electrostatic latent image developing magenta toner as defined in claim 1, wherein the naphthol pigment includes any one of pigment red 31, pigment red 146, pigment red 147, pigment red 150, pigment red 176, pigment red 238, and pigment red 269.

4. An electrostatic latent image developing magenta toner as defined in claim 1, wherein weight ratio of the quinacridone pigment to the naphthol pigment falls within a range of 80:20 to 20:80.

5. An electrostatic latent image developing magenta toner as defined in claim 1, wherein pigment content within the toner falls within a range of 5 to 15 wt %.

6. An electrostatic latent image developing magenta toner as defined in claim 1, wherein amount of the release agent added to the toner falls within a range of 5 to 40 wt %.

7. An electrostatic latent image developing magenta toner as defined in claim 1, wherein shape factor SF1 falls within a range of 115 to 140.

8. An electrostatic latent image developing magenta toner as defined in claim 1, wherein molecular weight distribution represented by ratio (Mw/Mn) of weight average molecular weight (Mw) to number average molecular weight (Mn) as measured by gel permeation chromatography falls within a range of 2 to 30.

9. An electrostatic latent image developing magenta toner as defined in claim 1, further including hydrophobicized silica.

10. An electrostatic latent image developing magenta toner as defined in claim 1, further including silica and a titanium compound.

11. An electrostatic latent image developer comprising an electrostatic latent image developing magenta toner and a carrier;

the magenta toner including a quinacridone pigment, a naphthol pigment, and a release agent, wherein colorant of the toner satisfies conditions (a) and (b) below:

(a) an average primary particle size D50 of a quinacridone pigment represented by formula (1) and an average primary particle size D50 of a naphthol pigment represented by formula (2) are such that the average primary particle size D50 of the quinacridone pigment is smaller than the average primary particle size D50 of the naphthol pigment; and (b) the average primary particle size D50 of the quinacridone pigment is greater than 20 nm, and the average primary particle size D50 of the naphthol pigment is smaller than 200 nm;

formula (1) being

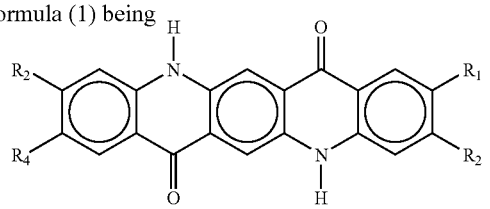

in which each of $R_1$, $R_2$, $R_3$, and $R_4$ is selected from the group consisting of H, $CH_3$, and Cl; $R_1$ and $R_2$ are different from each other; and $R_3$ and $R_4$ are different from each other; and formula (2) being

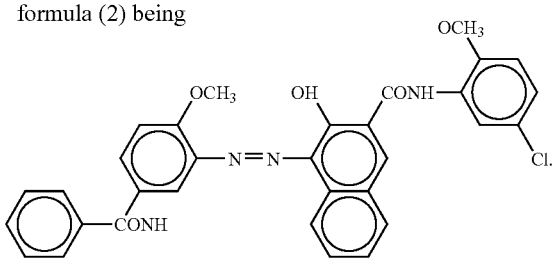

12. An electrostatic latent image developer as defined in claim 11, wherein the carrier is coated by a nitrogen-containing resin.

13. An electrostatic latent image developer as defined in claim 11, wherein the carrier includes a resin obtained by polymerizing acrylic or methacrylic acid alkyl ester having a branched alkyl group.

14. An electrostatic latent image developer as defined in claim 11, wherein electric resistance of the carrier falls within a range of $10^8$ to $10^{14}$ Ωcm.

15. An image forming method comprising the steps of:

forming a latent image on a latent image carrier;

developing the latent image by means of an electrostatic latent image developing toner;

transferring the developed toner image onto a receiver with or without use of an intermediate transfer member; and fixing the toner image on the receiver by heating and pressurizing; wherein a fixation device is used for the fixing step, the fixation device comprising rotating members which contact the receiver on front and back sides of the receiver, one of the rotating members being configured in the form of an endless belt, an average nip pressure F of the fixation device during the fixing step being no greater than 2.5 $kgf/cm^2$; and colorant of the electrostatic latent image developing toner satisfies conditions (a) and (b) below:

(a) an average primary particle size D50 of a quinacridone pigment represented by the above-noted formula (1) and an average primary particle size D50 of a naphthol pigment represented by the above-noted formula (2) are such that the average primary particle size D50 of the quinacridone pigment is smaller than the average primary particle size D50 of the naphthol pigment; and (b) the average primary particle size D50 of the quinacridone pigment is greater than 20 nm, and the average primary particle size D50 of the naphthol pigment is smaller than 200 nm;

F being given by F=A/D/N, wherein F ($kgf/cm^2$) denotes the average nip pressure during the fixing step, A (kgf) denotes total load applied on the fixation device, D (cm) denotes an average fixation nip width, and N (cm) denotes length of the fixation nip along the axial direction of a roll;

formula (1) being

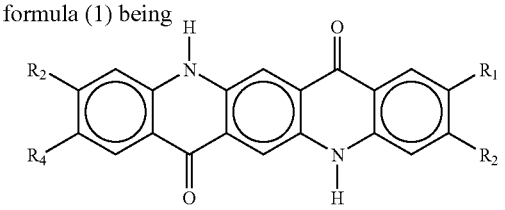

in which each of $R_1$, $R_2$, $R_3$, and $R_4$ is selected from the group consisting of H, $CH_3$, and Cl; $R_1$ and $R_2$ are different from each other; and $R_3$ and $R_4$ are different from each other; and formula (2) being

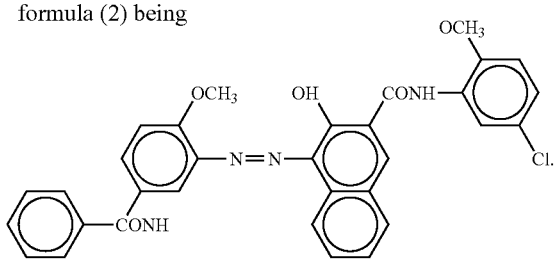

16. An image forming method as defined in claim 15, wherein value Gs(60) obtained by measuring, by the 60 degree specular gloss measurement method according to JIS Z 8741, image surface gloss after the fixing step falls within the range of 10 to 60.

* * * * *